US008355657B2

(12) United States Patent
Kadota et al.

(10) Patent No.: US 8,355,657 B2
(45) **Date of Patent: *Jan. 15, 2013**

(54) DEVELOPMENT UNIT, FOR IMAGE FORMING APPARATUS

(75) Inventors: Ichiro Kadota, Kawasaki (JP); Yasuyuki Ishii, Machida (JP); Tomoko Takahashi, Yokohama (JP); Masaaki Yamada, Tokyo (JP); Hideki Kosugi, Yokohama (JP); Yoshinori Nakagawa, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 1077 days.

This patent is subject to a terminal disclaimer.

(21) Appl. No.: 12/176,054

(22) Filed: Jul. 18, 2008

(65) Prior Publication Data

US 2009/0022523 A1 Jan. 22, 2009

(30) Foreign Application Priority Data

Jul. 18, 2007 (JP) ..... 2007-186544

(51) Int. Cl.
*G03G 15/08* (2006.01)

(52) U.S. Cl. ..... 399/266; 399/289; 399/290; 399/291; 430/123.2

(58) Field of Classification Search ..... 399/266, 399/289–291; 430/123.2
See application file for complete search history.

(56) References Cited

U.S. PATENT DOCUMENTS 4,866,480 A * 9/1989 Hosoya et al. ..... 399/281
5,339,141 A * 8/1994 Suzuki et al. ..... 399/285
5,495,322 A * 2/1996 Wada et al. ..... 399/285
5,517,287 A * 5/1996 Rodriguez et al. ..... 399/285
5,708,921 A * 1/1998 Yagi et al. ..... 399/98
5,708,940 A * 1/1998 Hosaka et al. ..... 399/266
5,734,956 A * 3/1998 Matalevich ..... 399/291
5,923,930 A 7/1999 Tsukamoto et al.
6,035,171 A * 3/2000 Takaya et al. ..... 399/281
6,115,576 A 9/2000 Nakano et al.
6,347,212 B1 2/2002 Kosugi et al.
6,422,696 B1 7/2002 Takahashi et al.
6,460,973 B1 10/2002 Takahashi et al.
6,623,816 B1 9/2003 Tanikawa et al.

(Continued)

FOREIGN PATENT DOCUMENTS

JP 03-21967 1/1991

(Continued)

OTHER PUBLICATIONS

Japanese Office Action issued Jan. 24, 2012 in patent application No. 2007-186544.

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

A development unit includes a toner carrying device, a regulating member, and a toner leak protection member. The toner carrying device having a first electrode and a second electrode arrayed with an interval. The first and second electrodes are supplied with a given voltage to set an electric field, changing in a time cycle, between the first and second electrodes. The electric field is used to hop toner over the toner carrying device to form a toner cloud for developing a latent image. The regulating member regulates an amount of toner on the toner carrying device. The toner leak protection member, made from a conductive material, prevents leakage of toner, and is supplied with a bias voltage.

16 Claims, 11 Drawing Sheets

U.S. PATENT DOCUMENTS

| | | | | |
|---|---|---|---|---|
| 6,658,227 | B2 | 12/2003 | Oyama et al. | |
| 6,736,500 | B2 | 5/2004 | Takahashi et al. | |
| 6,810,221 | B1 * | 10/2004 | Meyer et al. | 399/90 |
| 6,837,578 | B2 | 1/2005 | Tanikawa et al. | |
| 6,901,232 | B2 * | 5/2005 | Sakuma et al. | 399/266 |
| 6,934,496 | B2 * | 8/2005 | Sakuma et al. | 399/265 |
| 7,308,222 | B2 | 12/2007 | Nakagawa et al. | |
| 7,313,336 | B2 | 12/2007 | Kadota et al. | |
| 7,340,204 | B2 | 3/2008 | Nakazato et al. | |
| 7,450,870 | B2 * | 11/2008 | Iio et al. | 399/43 |
| 7,761,037 | B2 * | 7/2010 | Ohashi et al. | 399/258 |
| 8,005,409 | B2 * | 8/2011 | Ishii et al. | 399/289 |
| 2006/0216071 | A1 | 9/2006 | Yamada et al. | |
| 2006/0251449 | A1 | 11/2006 | Takahashi et al. | |
| 2007/0013924 | A1 | 1/2007 | Sakai et al. | |
| 2007/0015071 | A1 | 1/2007 | Tsukamoto et al. | |
| 2007/0025775 | A1 | 2/2007 | Takahashi et al. | |
| 2007/0086811 | A1 | 4/2007 | Tsukamoto et al. | |
| 2007/0160395 | A1 | 7/2007 | Kosugi et al. | |
| 2007/0212121 | A1 | 9/2007 | Takahashi et al. | |
| 2007/0242985 | A1 | 10/2007 | Aoki et al. | |
| 2008/0089720 | A1 | 4/2008 | Tsukamoto et al. | |
| 2008/0089723 | A1 | 4/2008 | Tsukamoto et al. | |
| 2008/0124138 | A1 | 5/2008 | Koshugi et al. | |
| 2008/0286015 | A1 * | 11/2008 | Kadota et al. | 399/266 |
| 2009/0035025 | A1 * | 2/2009 | Ishii et al. | 399/266 |
| 2009/0067889 | A1 * | 3/2009 | Nakagawa et al. | 399/266 |
| 2009/0257786 | A1 * | 10/2009 | Nakagawa et al. | 399/265 |
| 2009/0290901 | A1 * | 11/2009 | Ishii et al. | 399/103 |
| 2010/0021214 | A1 * | 1/2010 | Kadota et al. | 399/266 |
| 2010/0150615 | A1 * | 6/2010 | Nakagawa et al. | 399/265 |
| 2010/0329748 | A1 * | 12/2010 | Osaka et al. | 399/286 |
| 2011/0164892 | A1 * | 7/2011 | Ogawa et al. | 399/55 |
| 2012/0057891 | A1 * | 3/2012 | Ishikura et al. | 399/55 |
| 2012/0063815 | A1 * | 3/2012 | Seki et al. | 399/265 |
| 2012/0134721 | A1 * | 5/2012 | Abe et al. | 399/265 |

FOREIGN PATENT DOCUMENTS

| | | |
|---|---|---|
| JP | 03-100575 | 4/1991 |
| JP | 03-113474 | 5/1991 |
| JP | 7-110622 | 4/1995 |
| JP | 09-269661 | 10/1997 |
| JP | 2002-341656 | 11/2002 |
| JP | 2003-015419 | 1/2003 |
| JP | 2003-084560 | 3/2003 |
| JP | 2003-295615 | 10/2003 |
| JP | 2004-286837 | 10/2004 |
| JP | 2006-154710 | 6/2006 |
| JP | 2007-127921 | 5/2007 |
| JP | 2007-133387 | 5/2007 |
| JP | 2007-133388 | 5/2007 |
| JP | 2007-133389 | 5/2007 |

* cited by examiner

SURFACE POTENTIAL OF FLARE ROLLER $$V(t)=E\left(1-e^{-\frac{t}{R_{SUP}C}}\right)$$

$$\tau = R_{SUP}C$$

$R_{SUP}$: RESISTANCE OF SUPPLY ROLLER

C : CAPACITANCE OF FLARE ROLLER

E : POTENTIAL DIFFERENCE BETWEEN BIAS VOLTAGE FOR SUPPLY ROLLER AND AVERAGE BIAS VOLTAGE FOR FLARE ROLLER q : CHARGE INDUCED TO FLARE ROLLER $\tau$ : TIME CONSTANT

DEVELOPMENT UNIT, FOR IMAGE FORMING APPARATUS

CROSS-REFERENCE TO RELATED APPLICATIONS

This application claims priority under 35 U.S.C. §119(*a*) to Japanese Patent Application No. 2007-186544, filed on Jul. 18, 2007 in the Japan Patent Office, the entire contents of which are hereby incorporated by reference herein.

BACKGROUND OF THE INVENTION

1. Field of the Invention

The present disclosure generally relates to an image forming apparatus having a development unit, which develops a latent image on a latent image carrier using toner, and a process cartridge having the development unit.

2. Description of the Background Art

An image forming apparatus such as a copier, a plotter, a facsimile, or a multifunctional apparatus uses electrophotography for an image forming operation, for example. Such an image forming apparatus includes a development unit, which employs a two-component developing method using two-component developing agent including toner and magnetic carrier particles, or one-component developing method, which employs only toner as developing agent.

The two-component developing method, suitable for higher speed developing, is widely used for image forming apparatuses used for middle to high speed printing. In such two-component developing method, the developing agent needs to densely exist on a developing roller to produce a higher quality image, in which toner is transferred to a latent image on a latent image carrier. In light of such demand for higher quality image, smaller-sized carrier particles have been employed, and carrier particles having a diameter of about 30 μm are now available, for example.

The one-component developing method, suitable for reducing the size of developing mechanism, is widely used for image forming apparatuses used for low speed printing. In such a one-component developing method, a toner regulating member, such as for example a blade or a roller, is used to form a thin layer of toner on a developing roller. The toner is charged by the developing roller or the toner regulating member with an effect of frictional pressure. The thin layer of charged toner on the developing roller is transported to a developing area to develop a latent image on the latent image carrier. Such developing method may be a contact type and a non-contact type. In the contact type, a developing roller and a latent image carrier contact each other. While in the non-contact type, a developing roller and a latent image carrier do not contact each other.

As for the two-component developing method, a demand for higher quality image is growing in which an image dot size may need to be same or smaller than carrier particle diameter. Accordingly, a size of carrier particle needs to be further reduced to reproduce each one of image dots precisely. However, smaller-sized carrier particles cause several drawbacks. For example, carrier particles having smaller diameter have lower magnetic permeability, which may result into separation or drop-off of carrier particles from a developing roller. If such separated carrier particles adhere on a latent image carrier, a defective image may be produced, and the carrier particles may further physically damage the latent image carrier, for example.

Such carrier separation may be prevented by increasing the magnetic permeability of carrier particle or by increasing the magnetic force of a magnet installed in a developing roller. However, such attempts may have difficulties in achieving lower manufacturing cost and higher quality image at the same time. Further, with a growing demand for reducing a size of an image forming apparatus, a size of developing roller has been reduced. Thereby a developing roller having a strong magnetic field for preventing the carrier separation is difficult to devise.

In the two-component developing method, magnetic brushes composed of two-component developing agent are formed on a developing roller and the magnetic brushes are contacted against a latent image to form a toner image, wherein distribution of the magnetic brushes may have some unevenness across the developing roller, and thereby image dots may not be reproduced uniformly. Although an image quality can be enhanced by forming an alternating electric field between the developing roller and the latent image carrier, uneven distribution of magnetic brushes itself may not be eliminated completely.

In the one-component developing method, a thin layer of toner is formed on a developing roller by using a toner regulating member, by which such toner is strongly pressed against the developing roller, and thereby such toner may not respond to an electric field of a developing area so quickly. Accordingly, to obtain a higher quality image, an alternating electric field may be generated between the developing roller and the latent image carrier. However, such alternating electric field may not be sufficient to develop a higher resolution image composed of uniform tiny dots because the toner may not be stably supplied to a latent image.

Further, in the one-component developing method, toner receives greater stress from the toner regulating member when the thin layer of toner is formed on the developing roller, and thereby toner circulating in the development unit may degrade in a shorter time. If toner degrades, the thin layer of toner may not be formed uniformly on the developing roller. Accordingly, the one-component developing method may not be suitable for image forming apparatuses for high speed printing or extending durability of image forming apparatuses.

One related art reference Japanese Patent Application Publication H03 (1991)-100575 describes a kind of hybrid method which combines the two-component developing method and the one-component developing method to reduce drawbacks of the one-component developing method for some degree although the size and number of parts of the development unit increases. However, such a hybrid method may also have a drawback that may occur at a developing area as similar to the one-component developing method, by which a higher resolution image composed of uniform tiny dots may not be reliably formed.

Further, another related art reference Japanese Patent Application Publication H03 (1991)-113474 describes a method for developing a higher resolution image composed of uniform tiny dots, in which a wire supplied with a bias voltage having high frequency wave is disposed at a developing area so as to form a toner cloud over the developing area. Although such development unit may stably produce higher quality image, the development unit may have a complex configuration.

Further, another related art reference Japanese Patent Application Publication H03 (1991)-21967 describes a method for forming a toner cloud efficiently and stably, in which an electric field curtain is generated on a rotating roller. Such a development unit can produce higher quality image while reducing the size of the development unit. However, in order to obtain higher quality image using such development unit, development conditions such as for example the electric field curtain may be limited to a given condition. If the development conditions are deviated from such given condition, the development unit may unpreferably produce a lower quality image.

When an image is composed of plurality of colors, such as yellow, magenta, and cyan, a plurality of toner images (such as for example a first toner image, a second toner image, and a third toner image) are sequentially formed or developed on one single image carrier. In such a developing configuration, it is required that a toner image formed on the single image carrier at an earlier timing is not disturbed by another toner image to be formed on the single image carrier at a later timing.

The non-contact type developing method or toner cloud method can be used for a developing unit for developing a plurality of toner images by forming an alternating electric field between the image carrier and a developing roller. However, such alternating electric field may tear off a toner image formed on the image carrier at an earlier timing from the image carrier, and a torn-off first color toner may intrude in a development unit using a second color toner. Such phenomenon may disturb the toner image formed on the image carrier, and furthermore can mix different colors of toner in one development unit. The intermixing is not desirable for producing a high quality image.

A developing method using a toner cloud can be used for forming a higher quality image, but the development conditions to obtain higher quality image, such as for example the electric field curtain, may be limited to a given condition, and if the development conditions are not set to such certain level, the development unit may unpreferably produce a lower quality image, as above mentioned.

Further, another related art reference Japanese Patent Application Publication 2002-341656 describes a configuration in which a mechanical movement of a toner carrying device is eliminated for a developing process, and in which the toner is electrostatically transported on a transport base plate using an alternating electric field having three phases or more to transport toner using electrostatic force. However, if the toner cannot be electrostatically transported in such development unit due to some reasons, toner may accumulate on the transport base plate, by which the development unit may not function normally.

Further, another related art reference Japanese Patent Application Publication 2004-286837 describes a configuration that a development unit has a fixed base plate and a toner carrying device, in which the toner carrying device moves on the fixed base plate so as to reduce the aforementioned drawbacks that toner may accumulate on the transport base plate. However, such a development unit needs a complex configuration, which is not preferable. Similarly, other configurations having some variations for development units for transporting toner or carrier particles are disclosed in Japanese Patent Application Publications 2003-15419, H09 (1997)-269661, and 2003-84560.

In light of such drawbacks, other related art references Japanese Patent Application Publications 2007-13387, 2007-13388, 2007-13389, and US Patent Application Publications 2007/0086811, 2007/0160395, 2008/0089720, and 2008/0089723 describe a development unit using a developing roller (or a toner carrying device) having electrodes of two phases. In such a development unit, an electric field generated between electrodes can be changed in a given time cycle to hop toner particles on or over the developing roller. Such hopping toner particles are transported to a developing area between the image carrier and the developing roller with a rotation movement of the developing roller. Such a developing roller having fine-pitched electrodes of two phases is referred as a flare roller, hereinafter. The flare roller has a surface protection layer used for insulating the electrodes.

SUMMARY

In an aspect of the present invention, a development unit used with a latent image carrier includes a toner carrying device, a regulating member, and a toner leak protection member. The toner carrying device, facing the latent image carrier, has a first electrode and a second electrode arrayed with a given interval. The first electrode and the second electrode are supplied with a given voltage to set an electric field changing in a given time cycle between the first electrode and the second electrode. The electric field is used to hop toner particles on or over the toner carrying device to form a toner cloud for developing a latent image formed on the latent image carrier. The regulating member regulates an amount of toner on the toner carrying device. The toner leak protection member, made from a conductive material, prevents leakage of toner particles from the development unit. The toner leak protection member is disposed at a downstream side of the regulating member with respect to a direction of surface movement of the toner carrying device. The toner leak protection member is supplied with a bias voltage.

In another aspect of the present invention, an image forming apparatus includes a latent image carrier for carrying a latent image, and a development unit for developing the latent image carrier. The development unit includes a toner carrying device, a regulating member, and a toner leak protection member. The toner carrying device, facing the latent image carrier, has a first electrode and a second electrode arrayed with a given interval. The first electrode and the second electrode are supplied with a given voltage to set an electric field changing in a given time cycle between the first electrode and the second electrode. The electric field is used to hop toner particles on or over the toner carrying device to form a toner cloud for developing a latent image formed on the latent image carrier. The regulating member regulates an amount of toner on the toner carrying device. The toner leak protection member, made from a conductive material, prevents leakage of toner particles from the development unit. The toner leak protection member is disposed at a downstream side of the regulating member with respect to a direction of surface movement of the toner carrying device. The toner leak protection member is supplied with a bias voltage.

In another aspect of the present invention, a process cartridge detachably mountable in an image forming apparatus employing electrophotography and having a latent image carrier for carrying a latent image, a charger, and a cleaning unit. The process cartridge includes a development unit integrated with at least any one of the latent image carrier, the charger, and the cleaning unit. The development unit includes a toner carrying device, a regulating member, and a toner leak protection member. The toner carrying device, facing the latent image carrier, has a first electrode and a second electrode arrayed with a given interval. The first electrode and the second electrode are supplied with a given voltage to set an electric field changing in a given time cycle between the first electrode and the second electrode. The electric field is used to hop toner particles on or over the toner carrying device to form a toner cloud for developing a latent image formed on the latent image carrier. The regulating member regulates an amount of toner on the toner carrying device. The toner leak protection member, made from a conductive material, prevents leakage of toner particles from the development unit.

The toner leak protection member is disposed at a downstream side of the regulating member with respect to a direction of surface movement of the toner carrying device. The toner leak protection member is supplied with a bias voltage.

It is to be understood that both the foregoing general description of the invention and the following detailed description are exemplary, but are not restrictive of the invention.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
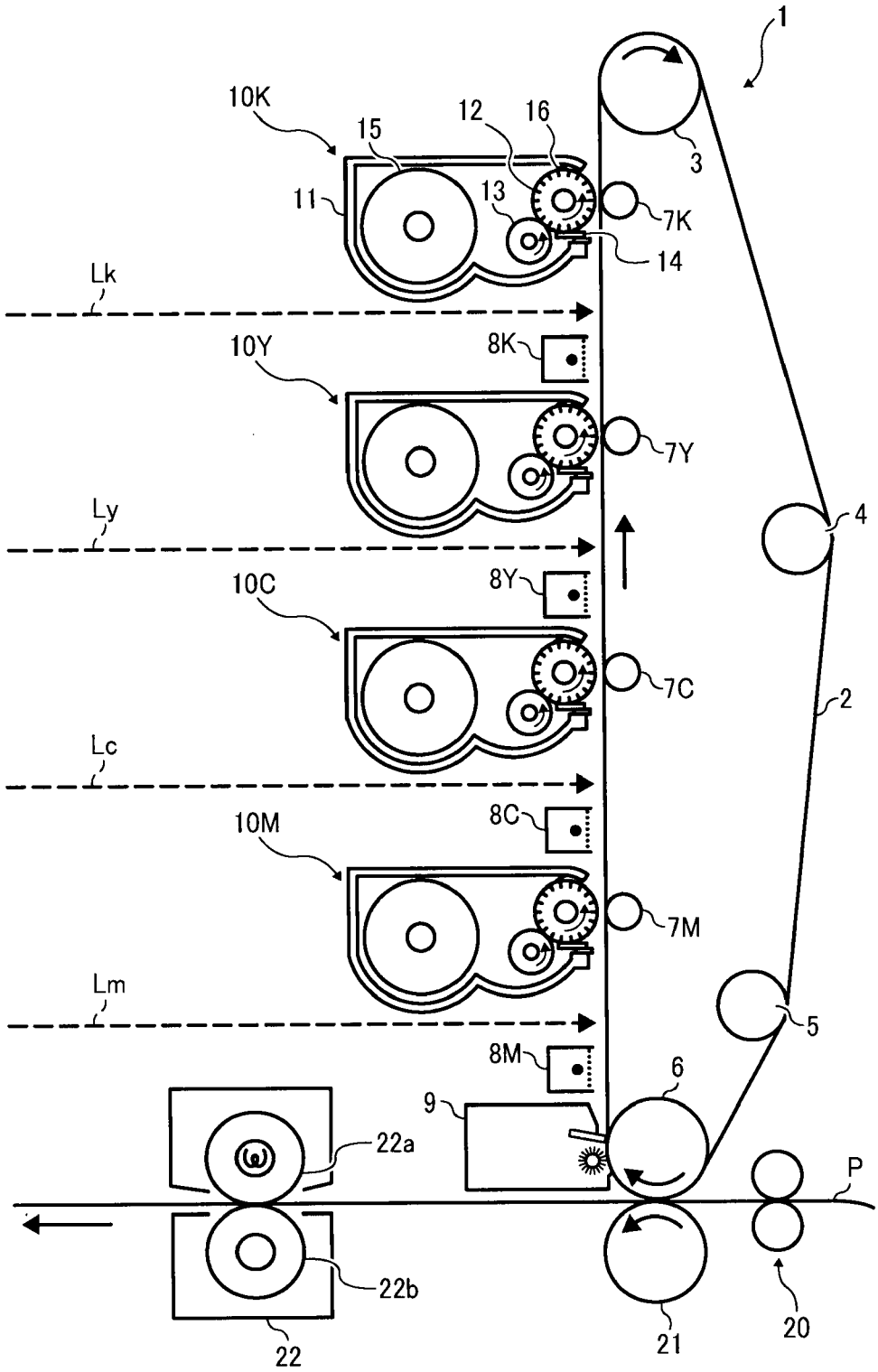
FIG. 1 illustrates a schematic configuration of an image forming apparatus according to an exemplary embodiment.

The accompanying drawings are intended to depict example embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXAMPLE EMBODIMENTS

A description is now given of example embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms a an and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an example embodiment is described with reference to accompanying drawings. The image forming apparatus may employ electrophotography, for example, and may be used as copier, printer, facsimile, or a multi-functional apparatus, but not limited thereto.

FIG. 1 illustrates a schematic configuration of an image forming apparatus according to an example embodiment. The image forming apparatus includes a plurality of development units employing a flare development configuration or method, which will be described later. The image forming apparatus includes a belt unit 1, a photoconductor 2, development units 10M, 10C, 10Y, and 10K, a registration roller 20, a transfer roller 21, a fixing unit 22, a sheet cassette, a sheet feeder, a feed route, for example. The photoconductor 2, used as a latent image carrier, may be an endless belt to which toner images of each color of magenta, cyan, yellow, and black are superimposed to form a full color image. In this disclosure, magenta, cyan, yellow, and black may be referred to as suffix letters of M, C, Y, and K.

Figure 2:
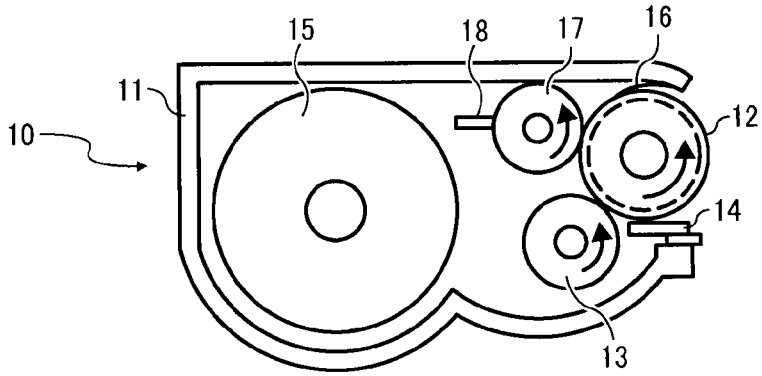
FIG. 2 illustrates a schematic configuration of a development unit according to an exemplary embodiment.

The development units 10M, 10C, 10Y, and 10K employing the flare development configuration have a similar configuration one to another except the color of toner. Accordingly, the development units 10M, 10C, 10Y, and 10K may be referred as the development unit 10 in this disclosure. As illustrated in FIG. 2, the development unit 10 includes a casing 11, a flare roller 12, a supply roller 13, a doctor blade 14, an agitation paddle 15, and a toner sealing member 16, for example.

The flare roller 12, used as a toner carrying device, carries toner particles thereon. The supply roller 13 supplies toner to the flare roller 12. The doctor blade 14 regulates a thickness of toner on the flare roller 12. The agitation paddle 15 agitates toner in the casing 11. The toner sealing member 16 prevents leakage of toner from the casing 11. The development unit 10 may further include a toner recovery roller 17, and a flicker 18 (as shown in FIG. 2). The flare development configuration for the development unit 10 will be described later in more detail.

The belt unit 1 includes the photoconductor 2 of endless belt, extended in a vertical direction rather than a horizontal direction, for example. The photoconductor 2 travels in a clockwise direction in FIG. 1, for example. More specifically, the photoconductor 2 is extended by a drive roller 3, tension rollers 4 and 5, a backup roller 6, and counter rollers 7M, 7C, 7Y, and 7K from an inner face side of the photoconductor 2. A drive unit (not shown) drives the drive roller 3 in a clockwise direction in FIG. 1, by which the photoconductor 2 endlessly travels in a clockwise direction in FIG. 1. As shown in FIG. 1, the photoconductor 2 has an extended flat face on its left side, which substantially extends in a vertical direction.

The development units 10M, 10C, 10Y, and 10K for magenta (M), cyan (C), yellow (Y), and black (K) are disposed along the extended flat face of the photoconductor 2 in a vertical direction while facing the extended flat face of the photoconductor 2.

Specifically, among the development units 10M, 10C, 10Y, and 10K, the development unit 10M is disposed as the lowest of the development units 10 in the vertical direction, and a charger 8M is disposed at a downside of the development unit 10M while facing the extended flat face of the photoconductor 2. Further, between the development unit 10M and the development unit 10C, a charger 8C is disposed while facing the extended flat face of the photoconductor 2. Further, between the development unit 10C and the development unit 10Y, a charger 8Y is disposed while facing the extended flat face of the photoconductor 2. Further, between the development unit 10Y and the development unit 10K, the charger 8K is disposed while facing the extended flat face of the photoconductor 2.

An optical writing unit (not shown) is disposed to a left side of the development units 10M, 10C, 10Y, and 10K arranged in the vertical direction in FIG. 1. The optical writing unit includes semiconductor lasers to emit light beams Lm, Lc, Ly, Lk for M, C, Y, and K based on image information received from a personal computer or a scanner, for example. The light beams Lm, Lc, Ly, Lk are irradiated to the photoconductor 2 by deflecting light beams at a polygon mirror, reflecting light beams by a reflection mirror, and passing the light beams through a lens. The optical writing unit may use a light emitting diode (LED) array instead of semiconductor laser. Further, such optical writing is conducted in a dark environment.

The photoconductor 2 travels straightly and upwardly in the vertical direction from the backup roller 6, disposed at the lowest side, to the drive roller 3, disposed at the uppermost side. Then, the photoconductor 2 travels downwardly in the vertical direction from the drive roller 3 to the backup roller 6.

The photoconductor 2 passing the backup roller 6 is uniformly charged by the charger 8M to a negative polarity side, for example. With the irradiation of the light beam Lm, a latent image M is formed on photoconductor 2. The latent image M is then developed as M toner image when the photoconductor 2 passes through the development unit 10M. Then, the photoconductor 2 is de-charged by a de-charger (not shown) to prepare for another image forming operation.

After the M toner image is formed on the photoconductor 2, the photoconductor 2 is uniformly charged by the charger 8C, and with the irradiation of the light beam Lc, a latent image C is formed on photoconductor 2. The latent image C is then developed as C toner image when the photoconductor 2 passes through the development unit 10C. Such C toner image is developed on the photoconductor 2 while superimposed on the M toner image formed on the photoconductor 2. Accordingly, the superimposed area shows a secondary color of M and C. Then, the photoconductor 2 is de-charged by a de-charger (not shown) to prepare for another image forming operation.

After the C toner image is formed on the photoconductor 2, the photoconductor 2 is uniformly charged by the charger 8Y, and with the irradiation of the light beam Ly, a latent image Y is formed on photoconductor 2. The latent image Y is then developed as Y toner image when the photoconductor 2 passes through the development unit 10Y. Such Y toner image is developed on the photoconductor 2 while superimposed on the M or C toner image formed on the photoconductor 2. Accordingly, the superimposed area shows a secondary color of M and Y, C and Y, or a tertiary color of M, C and Y. Then, the photoconductor 2 is de-charged by a de-charger (not shown) to prepare for another image forming operation.

After the Y toner image is formed on the photoconductor 2, the photoconductor 2 is uniformly charged by the charger 8K, and with the irradiation of the light beam Lk, a latent image K is formed on photoconductor 2. The latent image K is then developed as K toner image when the photoconductor 2 passes through the development unit 10K. Such K toner image is developed on the photoconductor 2 while superimposed on the M, C, or Y toner image formed on the photoconductor 2. Accordingly, the superimposed area shows a full color image having four superimposed toner images.

A transfer nip is formed between the photoconductor 2 and the transfer roller 21 while the backup roller 6 faces the transfer roller 21 via the photoconductor 2 and while the transfer roller 21 contacts a surface of the photoconductor 2. The backup roller 6 is grounded, whereas the transfer roller 21 (e.g., made from conductive material) is supplied with a transfer bias voltage by a bias voltage application unit (not shown). With such configuration, a transfer electric field can be generated between the backup roller 6 and the transfer roller 21, by which a toner image can be transferred from the photoconductor 2 to a recording sheet transported to the transfer nip.

Meanwhile, a recording sheet P (e.g., paper) is fed to the registration roller(s) 20, via a feed route, from a sheet cassette using a sheet feeder at a given timing. The registration roller 20 is disposed at an entry side of the transfer nip as shown in FIG. 1. The registration roller 20 sandwiches a leading edge of the recording sheet P and stops its rotation movement. Then, the registration roller 20 restarts its rotation movement to feed the recording sheet P to the transfer nip at a given timing, which is synchronized to a timing of superimposing toner images on the photoconductor 2.

At the transfer nip, superimposed toner images are transferred from the photoconductor 2 to the recording sheet P using a nip pressure and a transfer electric field to form full color image on the recording sheet P (e.g., white sheet).

Then, the recording sheet P is transported from the transfer nip to the fixing unit 22. The fixing unit 22 includes a heat roller 22*a*, and a pressure roller 22*b*, which forms a fixing nip between the heat roller 22*a* and the pressure roller 22*b*. The heat roller 22*a* has a heat source, such as halogen lamp, and the pressure roller 22*b* is pressed against the heat roller 22*a*. By applying heat and pressure at the fixing nip to the recording sheet P, a full color image is fixed on the recording sheet P.

Then, the recording sheet P is ejected to outside using a sheet ejection roller (not shown). After transferring the toner images at the transfer nip, toner remaining on the photoconductor 2 is removed by the cleaning unit 9.

In the above-described configuration, a plurality of color images (e.g., four color images) is formed on one single photoconductor such as photoconductor 2. Accordingly, deviations of relative positions of each of color images in a full color image may be reduced compared to a configuration arranging a plurality of photoconductors in a tandem manner, by which a full color image having higher quality image can be formed on the photoconductor 2 while reducing the positional deviation among color images.

Further, in the above-described configuration, the flare roller 12 (as the toner carrying device) and the photoconductor 2 do not contact each other, and an alternating electric field is not generated around the developing area. Accordingly, a toner image formed on the photoconductor 2 may not contact the flare roller 12 (used as the toner carrying device) of the development unit 10 used for a next developing process (i.e., no mechanical contact) and may not receive an effect of electric field. Image forming drawbacks, such as scavenging or mixing of different color toners, preferably do not occur in the development unit 10, and thereby higher quality image can be stably produced over time.

In general, scavenging may occur when a two-component development agent is used for developing process. When the two-component development agent is used, magnetic brushes (including for example chains of a carrier and a toner) are formed on a developing roller. A leading edge of the magnetic brushes may contact a photoconductor. If the leading edges of magnetic brushes contact the photoconductor, such leading edges may scrape toner particles, attracted to the photoconductor by a previous developing process, by physical contact effect or an electrical field effect. If such a scavenging phenomenon occurs, a first toner image already formed on the photoconductor by a first color developing process may be scraped from the photoconductor during a second color developing process, which may result in a degradation of image quality. Further, such a scavenging phenomenon may degrade image quality greatly when a plurality of toner color images are formed and superimposed on one single photoconductor.

A description is now given to a development unit employing a flare development configuration with reference to FIG. 2. As illustrated in FIG. 2, the development unit 10 includes the casing 11, the flare roller 12, the supply roller 13, the doctor blade 14, the agitation paddle 15, the toner sealing member 16, the toner recovery roller 17, and the flicker 18, for example. The flare roller 12, which may be also termed as "toner carrying device," carries toner particles thereon. The supply roller 13 supplies toner to the flare roller 12. The doctor blade 14 regulates thickness of toner on the flare roller 12. The agitation paddle 15 agitates toner in the casing 11. The toner sealing member 16 prevents leakage of toner from the casing 11. The toner recovery roller 17 recovers toner, which is not used for a developing process, from the flare roller 12.

The development unit 10 has a toner storage section in the casing 11 to store toner, and the agitation paddle 15 which can rotate in the toner storage section agitates the toner. The supply roller 13 disposed next to the toner storage section rotates in a counter-clockwise direction in FIG. 2. The toner agitated by the agitation paddle 15 in the toner storage section is carried onto the supply roller 13. Further, the flare roller 12 disposed next to the supply roller 13, as shown in FIG. 2, rotates in a counter-clockwise direction while contacting the supply roller 13. At such a contacting portion, toner is supplied from the supply roller 13 to the flare roller 12. To enhance toner supply efficiency from the supply roller 13 to the flare roller 12, a power source (not shown) is connected to the supply roller 13 to supply a supply bias voltage having same polarity of toner to the supply roller 13.

Toner particles supplied to the flare roller 12 are transported in a given direction with a rotation movement of the flare roller 12, such as for example a counter-clockwise direction of FIG. 2, while the toner particles hopping on or over the flare roller 12. Then, the doctor blade 14, fixed to the casing 11, regulates an amount of toner hopping on or over the flare roller 12.

One portion of the flare roller 12 is exposed to an outside of the casing 11 through an opening, and is opposed to the photoconductor 2 via the opening with a given gap between the photoconductor 2. When the toner on the flare roller 12 comes to a developing area facing the photoconductor 2 with a rotation movement of the flare roller 12, the toner develops a latent image formed on the photoconductor 2 (i.e., the developing process). After such a developing process, the toner recovery roller 17 recovers toner particles not used for the developing process when the flare roller 12 comes to a position of the toner recovery roller 17. Then, the flicker 18 scrapes the toner on the toner recovery roller 17 to recover the toner particles in the casing 11 when the toner recovery roller 17 comes to a position of the flicker 18 with a rotation movement of the toner recovery roller 17.

Figure 3:
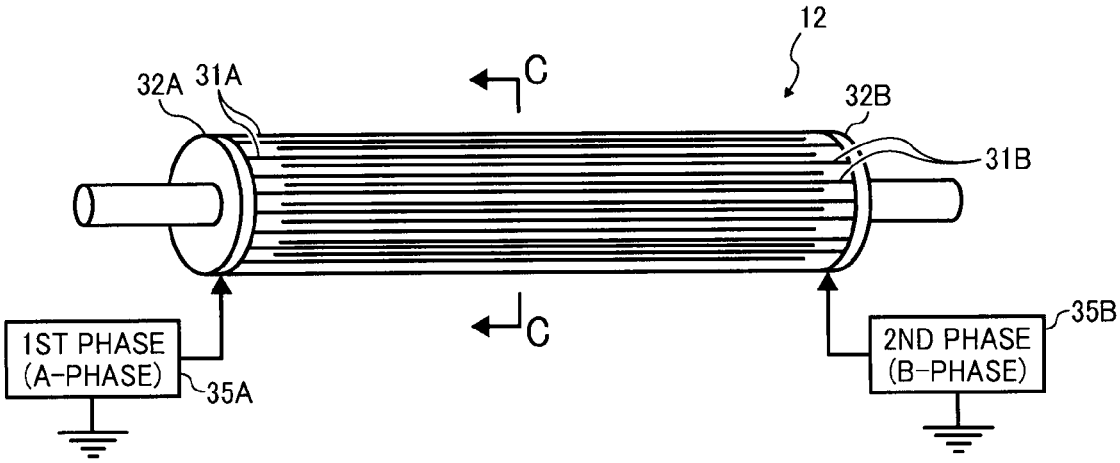
FIG. 3 illustrates a schematic perspective view of a flare roller, used as a toner carrying device for the development unit of FIG. 2.
Figure 4:
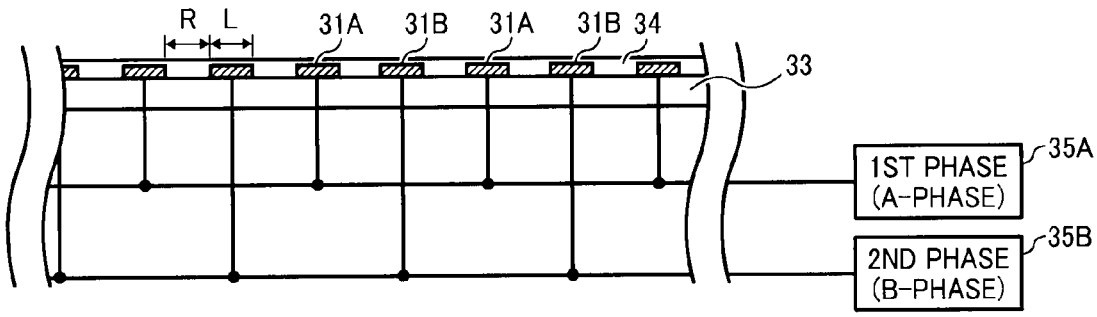
FIG. 4 illustrates electrodes of the flare roller of FIG. 3 and phases of bias voltages supplied to the electrodes.
Figure 5:
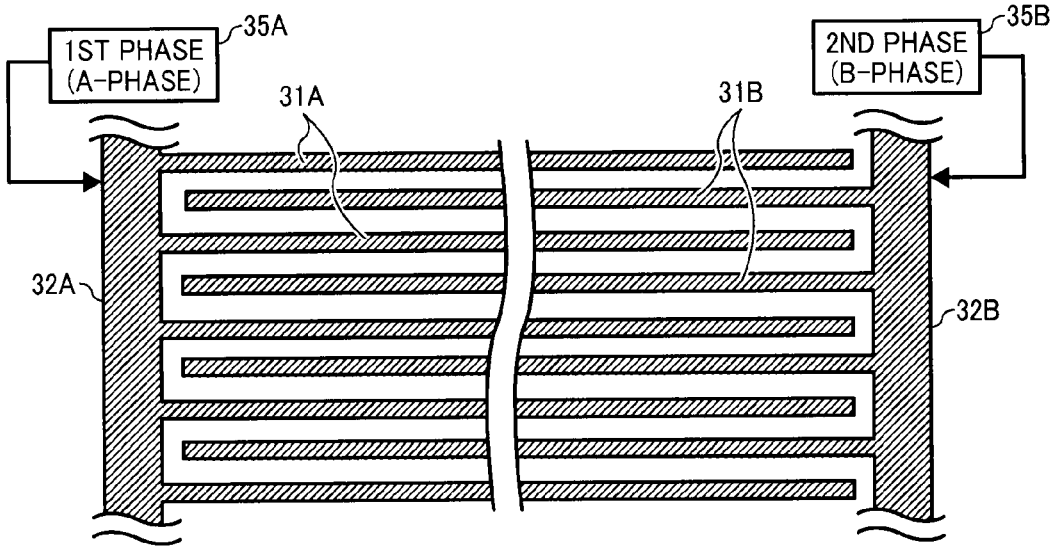
FIG. 5 illustrates an extended plan view of electrodes of the flare roller of FIG. 3.

A description is now given to a configuration of the flare roller 12 with reference to FIG. 3, which illustrates a perspective view of the flare roller 12. The flare roller 12 includes a plurality of electrodes on its surface portion, extending in an axial direction of the flare roller 12 and arranged in a circumferential direction of the flare roller 12 with a given pitch. Specifically, as illustrated in FIGS. 3 to 5, such a plurality of electrodes includes a first phase electrode 31A (or A-phase electrode 31A) and a second phase electrode 31B (or B-phase electrode 31B). The first phase electrode 31A is supplied with a first bias voltage (or A-phase bias voltage), and the second phase electrode 31B is supplied with a second bias voltage (or B-phase bias voltage). As illustrated in FIGS. 3 to 5, the first phase electrode 31A and the second phase electrode 31B each include a plurality of electrodes. Accordingly, the first phase electrode 31A and the second phase electrode 31B indicate one or more electrodes in this disclosure, and thereby the first phase electrode 31A indicates a first phase electrode group and the second phase electrode 31B indicates a second phase electrode group. The first phase electrode 31A and the second phase electrode 31B are alternately arranged in a circumferential direction of the flare roller 12 with a given pitch as shown in FIG. 3.

Further, as illustrated in FIGS. 3 and 5, the flare roller 12 includes a first common electrode 32A (or A-phase common electrode 32A) and a second common electrode 32B (or B-phase common electrode 32B) on an each end portion of the flare roller 12. The first common electrode 32A is disposed on an entire circumference of one end of the flare roller 12, to which one end of the first phase electrode 31A (or A-phase electrode 31A) is connected. Similarly, the second common electrode 32B is disposed on an entire circumference of the other end of the flare roller 12, to which one end of the second phase electrode 31B (or B-phase electrode 31B) is connected. As above-mentioned, the first phase electrode 31A and the second phase electrode 31B indicate a group of electrodes.

FIG. 4 illustrates a cross-sectional view of the flare roller 12, cut in a circumferential direction along the line C-C in FIG. 3. As illustrated in FIG. 4, the flare roller 12 further includes a support layer 33 and a surface protection layer 34. The first phase electrode 31A and the second phase electrode 31B are disposed alternately on the support layer 33 with a given pitch, and the surface protection layer 34, made from an insulation material (e.g., an inorganic or organic material), is layered on and over the electrodes 31A and 31B. The surface protection layer 34 is used to prevent contact of the electrodes 31A/31B and toner. Such a surface protection layer 34 is not disposed over the first common electrode 32A and the second common electrode 32B shown in FIG. 3, by which the common electrodes 32A and 32B are exposed.

An A-phase brush contact member (not shown) fixed to the casing 11 contacts the first common electrode 32A when the flare roller 12 rotates. A first phase (or A-phase) power source 35A (or a voltage application unit) is connected to the A-phase brush contact member so as to supply a first phase (or A-phase) voltage having a given bias voltage to the first phase electrode 31A via the A-phase brush contact member and the first common electrode 32A. Similarly, a B-phase brush contact member (not shown) fixed to the casing 11 contacts the second common electrode 32B when the flare roller 12 rotates. A second phase (or B-phase) power source 35B (or a voltage application unit) is connected to the B-phase brush contact member so as to supply a second phase (or B-phase) voltage having a given bias voltage to the second phase electrode 31B via the B-phase brush contact member and the second common electrode 32B. Each of the power sources 35A/35B may be a pulse power source which supplies a pulse voltage having a given time cycle, but not limited these. For example, the power source 35A or 35B may supply a constant voltage.

In FIG. 4, each line extending from electrodes 31A and 31B indicate a conductive line and the electrodes 31A and 31B are connected only at black circles, and are electrically insulated at other portion, in which a voltage is supplied to the electrodes 31A and 31B. Specifically, the power sources 35A/35B supply a first and second drive voltages to the electrodes 31A/32B respectively, wherein the first and second drive voltages may have different phases each other, for example.

In described in this invention, a group of first phase electrode 31A (or A-phase electrode 31A) supplied with the first phase (or A-phase) voltage may be referred "first phase electrode group (or A-phase electrode group)," and a group of second phase electrode 31B (or B-phase electrode 31B) supplied with the second phase (or B-phase) voltage may be referred "second phase electrode group (B-phase electrode group)."

Because the first phase electrode 31A and the second phase electrode 31B are alternately disposed on the flare roller 12, the first phase electrode 31A comes to odd number position or even number position from a given reference position in the circumferential direction of the flare roller 12. Specifically, when the first phase electrode 31A is set at the odd number position, the second phase electrode 31B is set at the even number position, and when the first phase electrode 31A is set at the even number position, the second phase electrode 31B is set at the odd number position.

FIG. 5 illustrates an extended plan view of electrodes of the flare roller 12. As shown in FIGS. 3 to 5, the flare roller 12 includes two-phase electrode groups, the first-phase electrode group (or A-phase electrode group) and the second-phase electrode group (or B-phase electrode group) which generate an electric field for hopping toner (or toner particles) on or over the flare roller 12. The first-phase electrode group may be at the even number position and the second-phase electrode group may be at the odd number position, or the first-phase electrode group may be at the odd number position and the second-phase electrode group may be at the even number position.

The first-phase electrode group and the second-phase electrode group are supplied with given pulse voltages (see FIG. 6A), for example, from the first-phase power source 35A and the second-phase power source 35B to generate a potential difference having a given time cycle between the first-phase electrode group and the second-phase electrode group. The pulse voltages of FIG. 6A have opposite phases each other, for example. The first-phase electrode group and the second-phase electrode are respectively connected to the aforementioned common electrodes, which are disposed at both end of the flare roller 12, which rotates in a given direction.

Figure 6A:
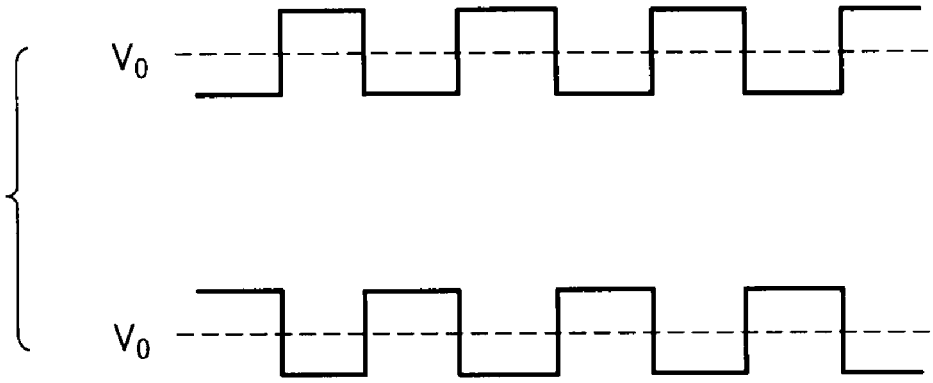
FIG. 6 shows example bias voltage pattern supplied to the electrodes of the flare roller of FIG. 3.

Specifically, a first-phase pulse voltage having a square wave shape, shown in upper part of FIG. 6A, is supplied to the first-phase electrode group, for example, while the first-phase pulse voltage changes its voltage with a given time cycle. Meanwhile, a second-phase pulse voltage having a square wave shape, shown in lower part of FIG. 6A, is supplied to the second-phase electrode group, for example. In this configuration, the second-phase pulse voltage changes its voltage with a given time cycle while the first-phase pulse voltage and second-phase pulse voltage have opposite phases each other.

When such pulse voltages are supplied to the flare roller 12, toner particles fly in a parabola manner on or over the flare roller 12 from the first phase electrode 31A to the adjacent second phase electrode 31B, and then fly back in the parabola manner from the second phase electrode 31B to the adjacent first phase electrode 31A. In other words, the toner particles fly back and forth between the first phase electrode 31A and second phase electrode 31B, adjacent provided each other. Specifically, toner particles may hop in a substantially vertical direction from the electrodes 31A/32A and land in a substantially vertical direction to the electrodes 31A/32A. Such flying movement of toner may be termed "reciprocating movement of toner," "hopping of toner" or "toner hopping," for example.

As such, the toner by hopping (or reciprocating movement) on or over the flare roller 12 is transported to the developing area with a rotation movement of the flare roller 12. When the hopping toner comes to a position proximate to a latent image on the photoconductor 2 around a top of parabolic hopping orbit in the developing area, the toner is shifted from the hopping orbit and attracted to the latent image with an effect of electrostatic force of the latent image. When the hopping toner comes to a position proximate to a surface portion of the photoconductor 2, which has no latent image, around a top of parabolic hopping orbit in the developing area, the toner is not shifted from the hopping orbit but falls on the flare roller 12. A portion having no latent image on the photoconductor 2 is a portion uniformly charged by a charging process.

In such configuration using the toner hopping, toner particles which are not attracted to the flare roller 12 so strongly or tightly can be used for a developing process, and the toner image can be developed at a lower potential, which may be difficult to achieve by a conventional one-component developing method or two-component developing method. As such, in the flare development configuration or method, toner reciprocatingly hopping between electrodes on or over the flare roller 12 is transported to the developing area with a rotation of the flare roller 12 to develop a latent image as a toner image (i.e., flare-type development process).

In the development unit 10, toner supplied from the supply roller 13 to the flare roller 12 hops on or over the flare roller 12 with an effect of electric field changing in a given time cycle. When the toner is transported to a position facing the photoconductor 2 with a rotation movement of the flare roller 12, the toner is attracted to a latent image on the photoconductor 2 with an effect of electric field between the latent image and toner to develop the latent image as a toner image.

Meanwhile, toner not used for a developing process passes through the toner sealing member 16 and comes to a position of the toner recovery roller 17. Because the toner is hopping on or over the flare roller 12, the toner is attracted to the flare roller 12 with smaller force, by which the toner can be recovered by the toner recovery roller 17 easily. When the flare roller 12 comes to a position of the supply roller 13, fresh toner is supplied to the flare roller 12, by which the flare roller 12 can be maintained at toner hopping state while providing a given amount of toner over time.

Further, the support layer 33 of the flare roller 12 may include an insulation material substrate, such as glass substrate, resin substrate, and ceramic substrate, for example. Alternatively, the support layer 33 may include a conductive material substrate, such as for example a stainless steel (SUS) substrate, and an insulation layer, such as for example $SiO_2$, formed on a conductive material substrate, or the support layer 33 may be include a polyimide substrate. Further, electrodes can be formed on the support layer 33 by forming a conductive layer, such as Al, Ni—Cr, with a thickness of 0.1 μm to 10 μm, preferably 0.5 μm to 2.0 μm, and patterning the conductive layer as electrodes using photolithography or the like.

A description is now given to an electrode width L, an electrode interval R, and the surface protection layer 34 used for toner hopping on the flare roller 12, with reference to FIG. 4. The electrode width L and the electrode interval R effect the toner hopping efficiency, and an electrode pitch P is defined as P=R+L.

Toner particles existing between adjacent electrodes may move to an adjacent electrode in a substantially horizontal direction on the surface protection layer 34 with an effect of the electric field, generated in a horizontal direction parallel to the flare roller 12, whereas toner particles existing on electrodes hop from the surface protection layer 34 in a substantially vertical direction with an effect of the electric field, generated in a vertical direction from a surface of the flare roller 12.

Further, toner particles existing on peripheral sides of electrodes may move a greater distance. For example, toner particles hopping from peripheral sides of one electrode may not land on an adjacent electrode, but rather land on a further adjacent electrode, which means toner particles move over from one electrode to another electrode by interposing an electrode between the one electrode and another electrode. Such phenomenon may not be preferable.

When a width L of an electrode has a greater width, the number of toner particles existing on the electrode becomes greater, and such toner particles may move a greater distance. If the electrode width L is too large, an electric field intensity at the center of the electrode may become lower, by which toner may be more likely attracted on the electrode. In this case, the number of hopping toner particles may become smaller, or hopping of toner may not occur efficiently. Based on research, the electrode width L has a preferred value for efficiently hopping toner at a lower voltage.

An electric field intensity of electrode is determined with a relationship of voltage supplied to the electrode and the electrode interval R, which is a distance between adjacent electrodes. In general, the smaller the electrode interval R, the greater the electric field intensity, by which toner can fly or hop with a faster speed. However, if the electrode interval R is too small, toner may move from one electrode to another electrode with a shorter length per one hopping, by which the toner may more likely stay around the flare roller 12 for a longer time. Although toner hopping time can be set longer by setting a higher frequency for a drive voltage. Based on research, the electrode interval R has a preferred interval or distance for efficiently hopping and transporting toner at a lower voltage.

Further, a thickness of the surface protection layer 34 covering the electrodes may effect the electric field intensity of the electrode, especially to a vertical direction component of an electric force line of the electric field. In this case, the thickness of the surface protection layer 34 effects toner hopping efficiency. Accordingly, a relationship of the electrode width L, the electrode interval R, and the thickness of the surface protection layer 34 of the flare roller 12 are adjusted to efficiently hop toner at a lower voltage.

In an exemplary embodiment, the electrode width L is set within a range of from one average particle diameter of toner particle to twenty times of average particle diameter of toner particle (1 toner diameter≦L≦20 times of toner diameter), and the electrode interval R is also set within a range of from one average particle diameter of toner particle to twenty times of average particle diameter of toner particle (1 toner diameter≦R≦20 times of toner diameter), for example.

The surface protection layer 34 can be made from an inorganic material, such as $SiO_2$, $BaTiO_2$, $TiO_2$, $TiO_4$, SiON, BN, TiN, $Ta_2O_5$, for example, and has a thickness of from 0.5 μm to 10 μm, and preferably from 0.5 μm to 3 μm, for example. Further, an organic material, such as polycarbonate, can be coated on $SiO_2$ or the like. Further, a zirconia or a coating material of carrier of two-component developing agent, such as silicone resin, can be selected. Materials used for the surface protection layer 34 are selected from viewpoints of insulation performance, durability, manufacturing method of the flare roller 12, and charging trend with respect to the toner.

When the development unit 10 is employed for an image forming apparatus, the flare roller 12 may need a given size. For example, the flare roller 12 can have electrodes having a fine pitched pattern and a roller size of 21 cm×30 cm for producing images having A4 image, for example.

A description is now given to a method for manufacturing of the flare roller 12, in which a flexible electrode pattern is formed and then flexible electrode pattern is wound around a support drum to prepare the flare roller 12.

A flexible thin substrate having fine-pitched electrodes can be prepared as below. A metal layer, such as Cu, Al, Ni—Cr, having a thickness of 0.1 μm to 0.3 μm, is formed on a base layer (support layer 33), such as polyimide, having a thickness of 20 μm to 100 μm using a vapor deposition method, for example. Such base layer can be manufactured by a roll-to-roll machine if the width of layer is from 30 cm to 60 cm, by which mass production efficiency can be enhanced. A common bus-line electrode can be formed with a width of 1 mm to 5 mm at the same time.

The vapor deposition method includes a sputtering method, an ion plating method, a chemical vapor deposition (CVD) method, an ion plating beam method, or the like. For example, when forming electrodes by a sputtering method, Cr (chromium) film may be used to enhance bonding performance of metal and polyimide. Further, such bonding performance of materials can be enhanced by a plasma processing or a primer processing.

Further, other than a vapor deposition method, an electrodeposition technique can be used to form a thin layer of electrodes, in which electrodes are formed on a polyimide base layer using an electroless plating process. Specifically, after forming an underlayer electrode by sequentially dipping the base layer in tin chloride, lead chloride, and nickel chloride, an electrolytic plating is conducted in Ni electrolytic solution to form a Ni film having a thickness of 1 μm to 3 μm (for example) using a roll-to-roll machine.

Then, a resist pattern is formed on such thin layer of electrode and a patterning and etching is conducted to form the electrode 31A and 31B. If a thin layer of electrode has a thickness of 0.1 μm to 3 μm, then fine-pitched electrode pattern having a width of 5 μm to several tens μm (for example) can be formed precisely by photolithography and etching process.

Then, as the surface protection layer 34, a layer of $SiO_2$, $BaTiO_2$, $TiO_2$, or the like having a thickness of 0.5 μm to 2 μm (for example) is formed using a sputtering method. Alternatively, as the surface protection layer 34, a polyimide (PI) layer having a thickness of 2 μm to 5 μm (for example) is applied by a roll coater or other coating machine, and baked. If the PI layer alone is not desirable, an inorganic film having a thickness of 0.1 μm to 0.5 μm (for example), such as $SiO_2$, is formed using a sputtering method, and an organic material, such as polycarbonate, may be coated on the inorganic film. Further, a zirconia or a coating material of carrier of two-component developing agent, such as silicone resin, can be selected for forming a layer. Such prepared flexible substrate can be fixed on a cylindrical shape drum to prepare the flare roller 12.

Alternatively, another flexible thin substrate having fine-pitched electrodes can be prepared as below. A metal layer, such as Cu, SUS, having a thickness of 10 μm to 20 μm (for example), is formed on a base layer (support layer 33), such as polyimide, having a thickness of 20 μm to 100 μm (for example) using a vapor deposition method. Then, a polyimide (PI) layer having a thickness of 20 μm to 100 μm (for example) is applied on the metal material by a roll coater or other coating machine, and baked. Then, the electrode 31 can be formed by photolithography and etching process, and the electrode 31 is coated by the surface protection layer 34 made from polyimide. Surface irregularity due to thickness of metal electrode may be smoothed. For example, polyimide material or polyurethane material having a viscosity of 50 to 10,000 cps, preferably 100 to 300 cps is applied by a spin coat method and left for some time, by which a surface irregularity of substrate can be smoothed by the material having a given level of surface tension. In this case, the flare roller 12 has a substantially smooth face.

Further alternatively, another flexible thin substrate having enhanced strength can be prepared as below. As a base layer, a metal layer (e.g., SUS, Al) having a thickness of 20 μm to 30 μm (for example) is coated with an insulation layer, made from polyimide, having a thickness of 5 μm (for example) using a roll coater. The insulation layer insulates the electrode and the base layer in this case. Such a polyimide is pre-baked (for example) at 150 degrees Celcius for 30 minutes, and post-baked at 350 degrees Celcius for 60 minutes, for example, to form a thin layer of the polyimide, by which the support layer 33 is formed.

Then, in one embodiment to enhance bonding performance of layers, a plasma processing or a primer processing is conducted. Then, a thin layer of electrode, made from for example Ni—Cr, having a thickness of 0.1 μm to 0.2 μm, is deposited, and the electrode 31 having fine pattern, such as several tens μm (for example), is formed by photolithography and etching process. Then, as the surface protection layer 34, a layer of $SiO_2$, $BaTiO_2$, $TiO_2$, or the like having a thickness of 0.5 μm to 1 μm (for example) is formed using a sputtering method, by which the support layer 33 having flexible electrode pattern is obtained. Further, an organic material, such as polycarbonate, may be coated on the inorganic film, such as $SiO_2$. Further, zirconia or a coating material of carrier of two-component developing agent, such as silicone resin, can be selected for forming a layer.

Figure 7:
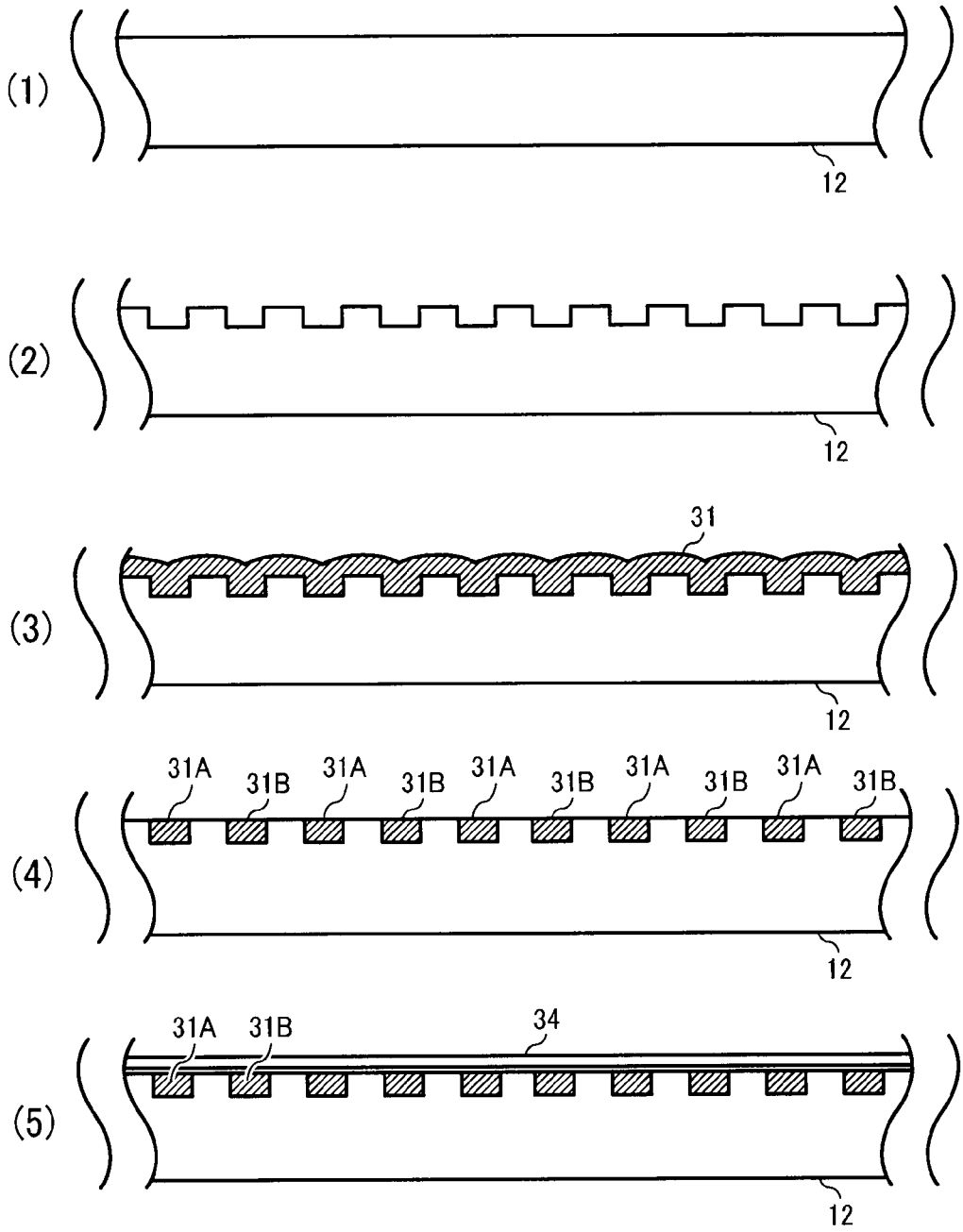
FIG. 7 illustrates one example process for manufacturing the flare roller of FIG. 3.

Further, the flare roller 12 can be manufactured by another method, in which electrodes are patterned on a cylindrical drum, and a surface protection layer is formed on the electrodes. Such method is described with reference to FIG. 7. In FIG. 7, an electrode patterned is formed using processes (1) to (5). The drawing of processes (1) to (5) in FIG. 7 is a partial cross-sectional view of a surface portion of the flare roller 12, cut in a circumferential direction.

At process (1), a surface of the flare roller 12 is turned by a lathe to finish the surface as a smooth surface. At process (2), grooves are cut with a groove pitch of 100 μm and groove width of 50 μm, for example. At process (3), electroless nickel plating is conducted to form an electrode film 31. At process (4), cutting is conducted to remove unnecessary conductive film, by which the first phase electrode 31A (or A-phase electrode 31A) and the second phase electrode 31B (or B-phase electrode 31B) are formed in the grooves. At process (5), the surface protection layer 34 of silicone resin is coated to protect and smooth the surface of the flare roller 12. The surface protection layer 34 has a thickness of about 5 μm and a volume resistivity of about $10^{10}$ Ω·cm, for example.

Further, the flare roller 12 can be manufactured by other methods, such as a screen printing or an inkjet printing using conductive ink, removing non-electrode portion from a coated electrode using laser. Further, the electrode pattern and the surface protection layer of the flare roller 12 can be manufactured by other methods, and silver (Ag) and copper (Cu) can be used as electrode material.

Figure 8:
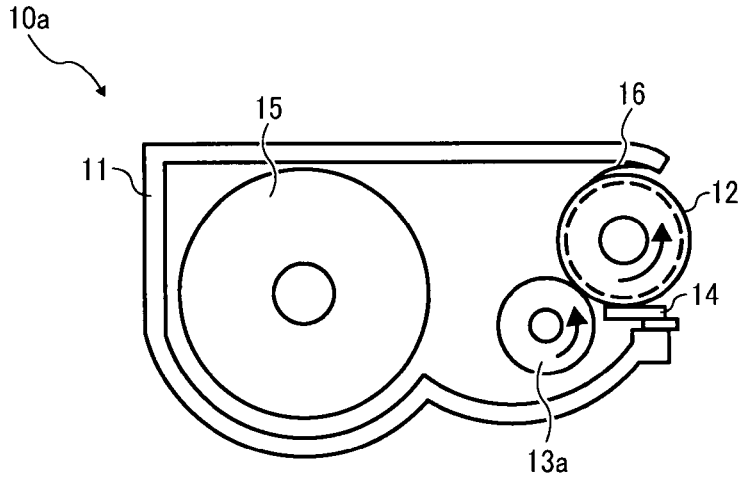
FIG. 8 illustrates a schematic configuration of a development unit according to another exemplary embodiment.

A description is now given to another development unit according to another embodiment with reference to FIG. 8. As show in FIG. 8, a development unit 10*a* includes a supply/recovery roller 13*a*. The agitation paddle 15 transports toner from the toner storage section to the supply/recovery roller 13*a*. The supply/recovery roller 13*a* rotates in a counter direction with respect to a rotation of the flare roller 12, and supplies/recovers toner to the flare roller 12. Accordingly, in the development unit 10*a*, one single roller (i.e., roller 13*a*) is used for toner supply and recovery. Meanwhile, as shown in FIG. 2, the supply roller 13 and the toner recovery roller 17 can be disposed separately.

When the toner supply/recovery roller 13*a* supplies toner to the flare roller 12, the toner is charged by friction. The toner on the flare roller 12 is regulated by the doctor blade 14 to set a toner amount at a given level. The doctor blade 14 is made from an insulation material, such as for example rubber.

The toner regulated by the doctor blade 14 is uniformly distributed on the flare roller 12 and transported to the developing area while hopping on or over the flare roller 12, and the toner develops a latent image on the photoconductor 2 in a non-contact manner. Toner not used for a developing process passes through the developing area and the toner sealing member 16, and is then recovered by the toner supply/recovery roller 13*a* to the toner storage section. In contrast, the toner recovery roller 17 recovers toner to the toner storage section in a configuration shown in FIG. 2.

A description is now given to the toner sealing member 16. The toner sealing member 16 is disposed adjacently the flare roller 12 and fixed to the casing 11 as shown in FIGS. 2 and 8. The toner sealing member 16 prevents leakage of toner from the casing 11 of the development unit 10. The toner sealing member 16 is made from an elastic material having a given conductivity and formed in a thin plate, for example. One end of the toner sealing member 16 is fixed to the casing 11, and the other end of the toner sealing member 16 is pressed against the flare roller 12 elastically. Such toner sealing member 16, having a relatively simpler configuration, can prevent leakage of toner outside of the development unit 10*b* and can be used to maintain a surface potential of the flare roller 12 at a given level as described later.

However, when the flare roller 12 rotates, a surface potential of the flare roller 12 may fluctuate due to several reasons. For example, as detailed below, frictional electrification between a toner regulating member and the flare roller, frictional electrification between hopping toner and the flare roller, and charge injection to the flare roller caused by a potential difference between a bias voltage supplied to a toner supply roller and a bias voltage supplied to the flare roller may cause a fluctuation of the surface potential of the flare roller. Such a fluctuation of surface potential of the flare roller may lead to a fluctuation of potential difference at a developing area between the flare roller and the latent image carrier. Specifically, a potential difference between the flare roller and a latent image area on the latent image carrier may fluctuate, by which image concentration may become non-uniform or fogging may occur.

Accordingly, it is desired to reduce a fluctuation or variation of the surface potential of the flare roller (toner carrying device) to form a toner image reliably.

A description is now given to experimental conditions used for the flare roller 12 and the toner sealing member 16. Specifically, a given bias voltage was supplied to electrodes of the flare roller 12, and a given bias voltage was supplied to the toner sealing member 16.

EXAMPLE 1

In Example 1, a square wave shown in FIG. 6A was used as a drive pulse for hopping toner. For example, square wave bias voltage (or pulse voltage) having an average voltage value of −200 V, a frequency f of 1 kHz, and a peak-to-peak voltage Vpp of 300 V was supplied to the electrodes 31A and 31B. In this example, the square wave bias voltages supplied to the electrodes 31A and 31B had opposite phases to each other. Further, the toner sealing member 16 was supplied with a direct current (DC) bias voltage of −200 V, which is same as an average voltage value of −200 V of the drive pulse supplied to any one of the electrodes 31A or 31B. As such, because bias voltages changing in a given time cycle having opposite phases are supplied to the first and second phase electrodes 31A and 31B, an average value of bias voltage supplied to the flare roller can be maintained at a given level. As shown in FIG. 6A, the square wave depicted has a 50% duty cycle, but as described below other duty cycles are suitable for the invention.

In Example 1, the square wave has a duty cycle of 50%, by which an average voltage Vave of the bias voltage supplied to the flare roller 12 became equal to an offset voltage V0 of the square wave bias voltage, and a DC (direct current) voltage the same as such offset voltage was supplied to the toner sealing member 16.

If a pulse wave of bias voltage has a duty cycle other than 50%, an average voltage Vave of bias voltage supplied to the flare roller 12 is not equal to an offset voltage V0 of pulse wave. In such a case, the toner sealing member 16 is supplied with a bias voltage, substantially same as an average voltage Vave of the bias voltage supplied to the flare roller 12, to set the toner sealing member 16 at a substantially same potential of the flare roller 12.

Figure 9:
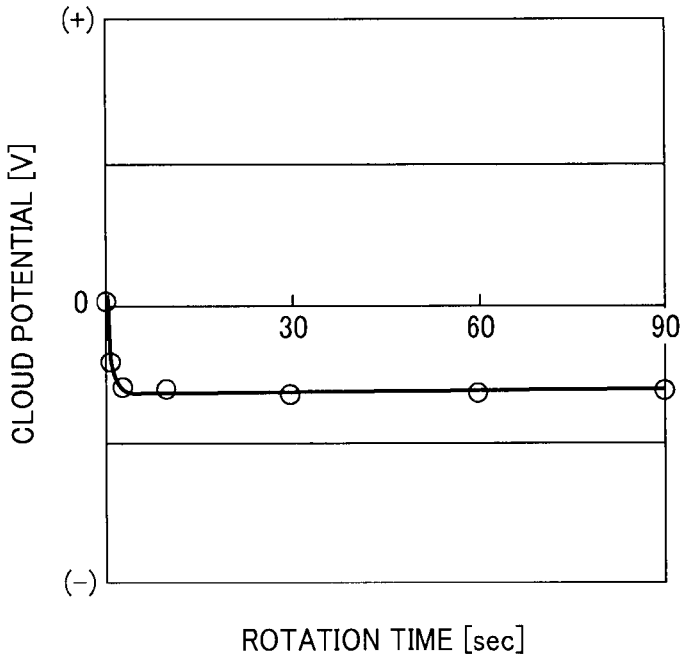
FIG. 9 is a graph showing a relationship of a rotating time of the flare roller and a cloud potential.

In Example 1, when the flare roller 12 in the development unit 10 of FIG. 2 were rotated continuously, an amount of toner attracted on the flare roller 12 and a charging amount of toner passed through the doctor blade 14 was maintained at a given level. Further, as shown in FIG. 9, a cloud potential was maintained at a given level. The cloud potential means a surface potential of the flare roller 12 that toner is attracted thereon, and the toner is maintained in a hopping state by supplying the aforementioned bias voltage to the flare roller 12. If the cloud potential can be maintained at a given level, a potential difference between the surface potential of the flare roller 12 and a latent image potential of the photoconductor 2 can be maintained at a given level. As such, an image concentration can be maintained at a given level and a good level of image forming operation can be conducted without causing drawbacks, such as fogging.

COMPARATIVE EXAMPLE 1

Figure 10:
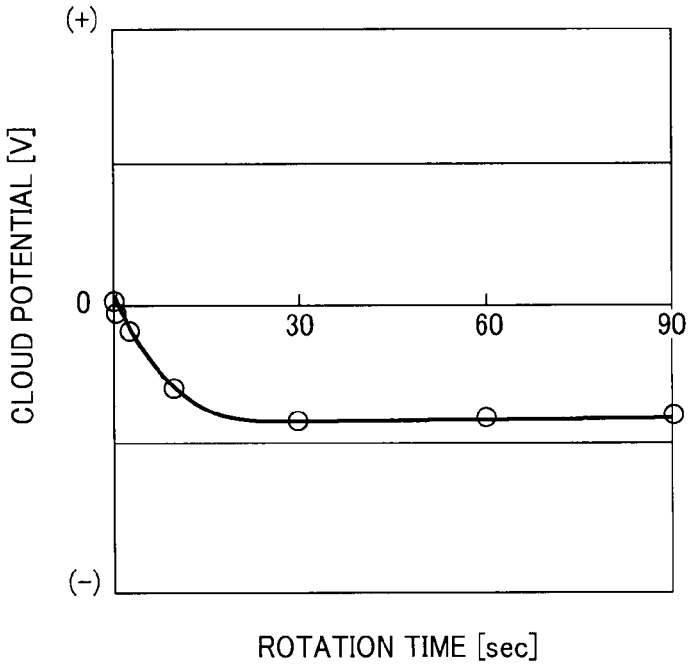
FIG. 10 is another graph showing a relationship of a rotating time of the flare roller and a cloud potential.

In Comparative Example 1, the flare roller 12 was supplied with the bias voltage as similar to Example 1 while supplying −400 V to the toner sealing member 16. In this example, the cloud potential continuously decreased for about 20 seconds after starting a rotation of the flare roller 12 as shown in FIG. 10. Accordingly, a developing potential was not maintained at a preferable level at the developing area, by which image concentration became dark and fogging occurred.

Further, it was confirmed that a toner supply potential became substantially smaller than an initial toner supply potential, by which toner was not sufficiently supplied to the flare roller 12 over time. The toner supply potential is a potential difference between a bias voltage supplied to the supply roller 13 and a surface potential of the flare roller 12.

If a surface potential of a flare roller can be maintained at a given level, a toner supply potential between a supply roller and a flare roller can be maintained at a given level. In this case, a developing potential between the flare roller and an latent image on a photoconductor can be maintained at a given level, and thereby an toner image can be effectively formed on a photoconductor. However, a surface potential of a flare roller may fluctuate in a conventional configuration by the described factors described below.

In Comparative Example 1, the surface potential of the flare roller 12 was 0 V right after starting the rotation of the flare roller 12, by which a desired image was produced. However, when the surface potential of the flare roller 12 became too large to negative side, a developing potential, which is a potential difference between the surface potential of the flare roller 12 and the latent image potential of the photoconductor 2, became too large, by which an image concentration became unpreferably dark.

EXAMPLE 2

Figure 6B:
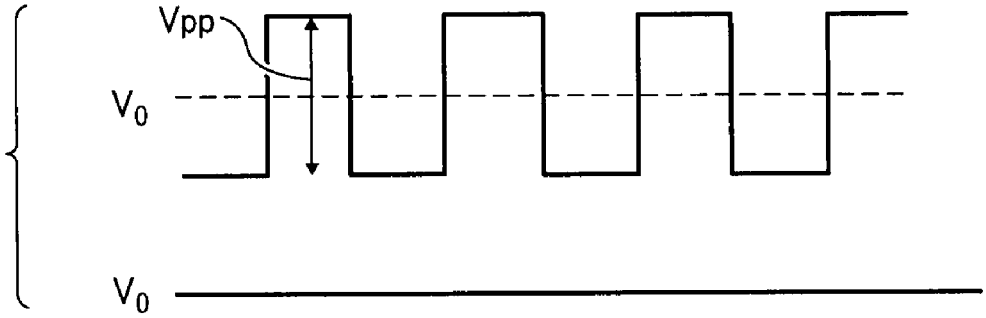

In Example 2, a configuration similar to Example 1 was used for the development unit 10, and the flare roller 12 was supplied with a square wave (pulse voltage) shown in FIG. 6B as a bias voltage for hopping toner. Specifically, one of the first phase and second phase electrodes 31A and 31B was supplied with the square wave bias voltage (pulse voltage) having an average voltage value of −300 V, a frequency f of 1 kHz, and a peak-to-peak voltage Vpp of 600 V shown in an upper part of FIG. 6B. Such square wave had a 50% duty cycle, for example. Another one of the first phase and second phase electrodes 31A and 31B was supplied with a DC bias voltage of −300 V shown in a lower part of FIG. 6B.

In such configuration, toner can be also hopped even when one of the electrodes 31A and 31B is constantly supplied with a DC voltage having a given value and the other electrode is supplied with a square wave bias voltage—(e.g., a pulse voltage). If one of the bias voltages supplied to the flare roller 12 is set to a DC bias voltage, the number of pulse generating power source can be reduced for one power source. Accordingly, a cost reduction of power source unit can be achieved because a pulse generating power source is relatively expensive compared to a DC power source.

Further, the toner sealing member 16 was supplied with DC bias voltage (see V0 at lower part of FIG. 6B), by which a potential supplied to the toner sealing member 16 and an average voltage of the bias voltage supplied to the flare roller 12 were set to a substantially same level. With such a configuration, the surface potential of the flare roller 12 was maintained at a given level, and the cloud potential was maintained at a given level when the flare roller 12 was rotated continuously. Accordingly, a good level of image forming operation was conducted without causing unevenness on image concentration.

EXAMPLE 3

In Example 3, a configuration similar to Example 1 was used for the development unit 10, and the flare roller 12 was supplied with a square wave bias voltage (pulse voltage) shown in FIG. 6A as a bias voltage for hopping toner. Specifically, both of the first phase and second phase electrodes 31A and 31B were supplied with a square wave bias voltage (pulse voltage) having an average voltage of −300 V, a frequency f of 1 kHz, and a peak-to-peak voltage Vpp of 300 V. Bias voltages having opposite phases were supplied to the first and second phase electrodes 31A and 31B. Further, the toner sealing member 16 was supplied with a square wave bias voltage (pulse voltage) having an average voltage value of −300 V, a frequency f2 of 500 Hz, and a peak-to-peak voltage Vpp2 of 400 V.

When the flare roller 12 was rotated continuously, the cloud potential was maintained at a given level even under such condition. Accordingly, a good level of image forming operation was conducted without causing unevenness on image concentration. As above described in Example 3, even when different square wave patterns are supplied to the first and phase electrodes 31A/31B and the toner sealing member 16, the cloud potential can be maintained at a given level.

As such, because bias voltages changing in a given time cycle having opposite phases are supplied to the first and second phase electrodes 31A and 31B, by which an average value of bias voltage supplied to the flare roller 12 can be maintained at a given level. Further, because a bias voltage changing in a given time cycle is supplied to the toner leak protection member, a surface potential of the flare roller 12A can be maintained at a given level.

EXAMPLE 4

In Example 4, the flare roller 12 was supplied with the bias voltages used in Example 3, and the toner sealing member 16 was supplied with a square wave bias voltage, which is same as one of the bias voltages supplied to one of the first and second phase electrodes 31A and 31B of the flare roller 12. Accordingly, square waves having opposite phases were supplied to the first and second phase electrodes 31A and 31B, and the toner sealing member 16 was supplied with one of such square waves. When the flare roller 12 was rotated continuously under such condition, the cloud potential was maintained at a given level. Accordingly, a good level of image forming operation was conducted without causing unevenness on image concentration.

As such, because bias voltages changing in a given time cycle having opposite phases are supplied to the first and second phase electrodes 31A and 31B, by which an average value of bias voltage supplied to the flare roller 12 can be maintained at a given level. Further, because the bias voltages waves having opposite phases were supplied to the first and second phase electrodes 31A and 31B and the toner sealing member 16 was supplied with one of such bias voltages, a flare development system having the flare roller 12 can be configured with at least two power sources for generating drive pulse without configuring a power source specifically used for the toner sealing member 16. In this case, the number of power sources and associated cost can be reduced.

EXAMPLE 5

In Example 5, a configuration similar to Example 1 was used for the development unit 10, and the flare roller 12 was supplied with a square wave bias voltage (pulse voltage) shown in FIG. 6B as a bias voltage for hopping toner. Specifically, one of the first phase and second phase electrodes 31A and 31B was supplied with a square wave bias voltage (pulse voltage) having an average voltage of −300 V, a frequency f of 1 kHz, and a peak-to-peak voltage Vpp of 600 V. The other one of the first phase and second phase electrodes 31A and 31B was supplied with a DC bias voltage of −300 V (see V0 in a lower part of FIG. 6B). Further, the toner sealing member 16 was supplied with a square wave bias voltage, which is same as the square wave supplied to one of the first and second phase electrodes 31A and 31B. Accordingly, a square wave having one given phase was supplied to one of the first and second phase electrodes 31A and 31B, a DC bias voltage was supplied to the other one of the first and second phase electrodes 31A and 31B, and the toner sealing member 16 was supplied with a square wave, same as the square wave supplied to one of the electrodes 31A and 31B. When the flare roller 12 was rotated continuously under such condition, the cloud potential was maintained at a given level. Accordingly, a good level of image forming operation was conducted without causing unevenness on image concentration. As such, because a flare development system having the flare roller 12 uses only one power source for generating drive pulse, by which the number of power sources and associated cost can be reduced.

Figure 11:
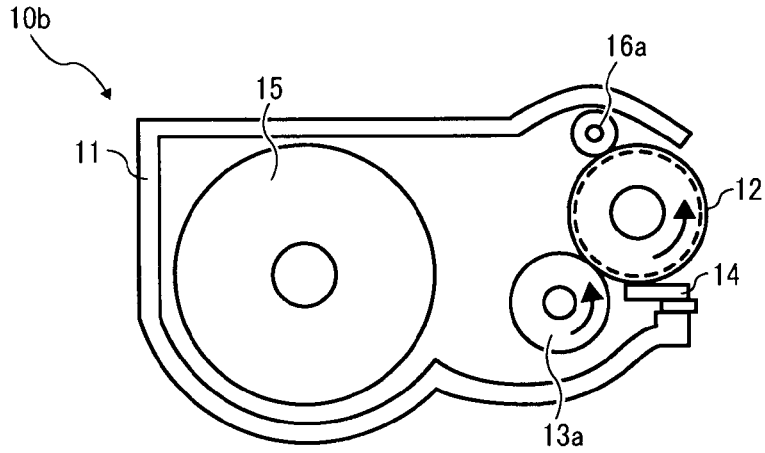
FIGS. 11 and 12 illustrate schematic configurations of development units according to another exemplary embodiments.

A description is now given to another development unit according to another exemplary embodiment with reference to FIG. 11. A development unit 10*b* of FIG. 11 includes a toner sealing member 16*a*, made from an elastic member and formed in a cylindrical shape, and the toner sealing member 16*a* is pressed against the flare roller 12. Such toner sealing member 16*a* can prevent leakage of toner outside of the development unit 10*b* and can be used to maintain a surface potential of the flare roller 12 at a given level as similar to the above toner sealing member 16.

Figure 12:
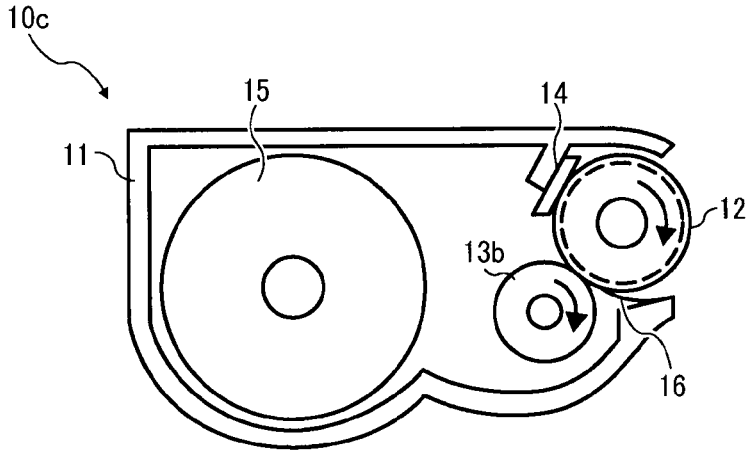

Further, as illustrated in a development unit 10*c* of FIG. 12, the flare roller 12 can be rotated into a clockwise direction, which is different from the flare roller 12 shown in FIG. 2 or FIG. 8, rotating in a counter-clockwise direction. As such, the flare roller 12 can be rotated into any rotational direction.

A description is now given to mechanism, which causes fluctuation or variation of surface potential of the flare roller 12. In Examples 1 to 5, such fluctuation or variation of surface potential was suppressed or reduced by supplying a given suitable bias voltage to the toner sealing member 16. Based on research, it is assumed that following factors may cause fluctuation or variation of surface potential of the flare roller 12.

(1) Accumulation of Charges: Capacitor Model

Figure 13:
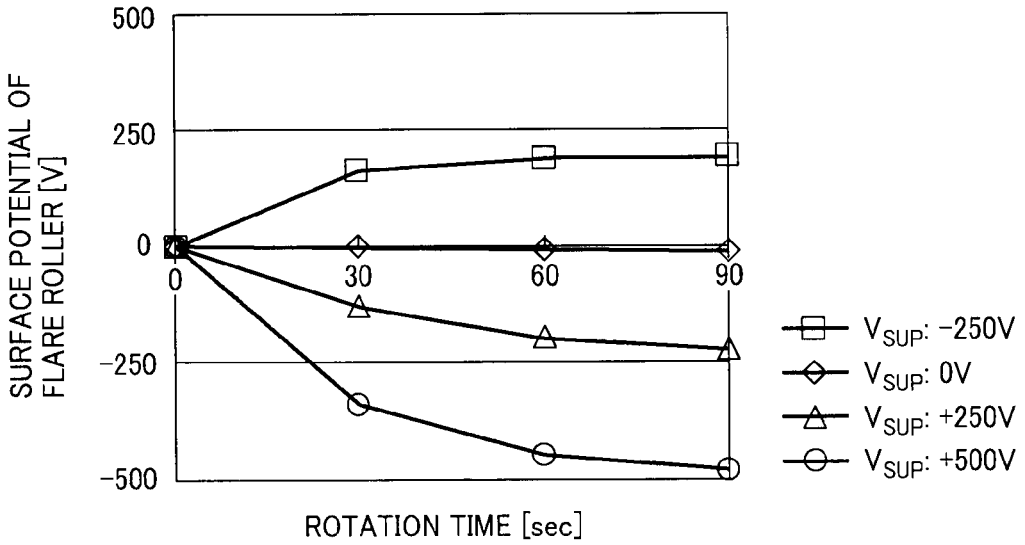
FIG. 13 is a graph of a surface potential of a flare roller with respect to a rotation time of flare roller, in which a supply roller and a flare roller are rotated without inputting toner.

To estimate an effect of interaction of the supply roller 13 and the flare roller 12 to a surface potential of the flare roller 12, the supply roller 13 and the flare roller 12 were rotated without inputting toner in the development unit 10, and the surface potential of the flare roller 12 was measured over time to obtain measurement result shown in FIG. 13. In FIG. 13, Vsup means a voltage supplied to the supply roller 13, and both of the first and second phase electrodes 31A and 31B were supplied with 0 (zero) voltage. Accordingly, the measurement result of FIG. 13 indicates a change of surface potential of the flare roller 12 over time.

Figure 14:
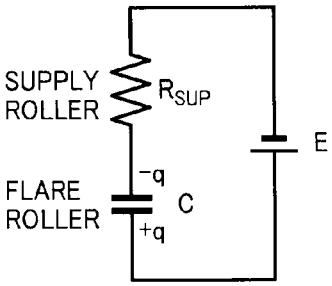
FIG. 14 illustrates a capacitor model for the flare roller.

A configuration of the supply roller 13 and the flare roller 12 can be modeled as a capacitor model, which has a RC series circuit composed of a resistance R and a capacitor C as shown in FIG. 14.

Based on the measurement result of FIG. 13, the surface potential of the flare roller 12 is assumed as a surface potential of the capacitor C, to which charges accumulate. Accordingly, charges continue to accumulate on the surface protection layer 34 of the flare roller 12 until the potential difference between the supply roller 13 and the flare roller 12 becomes zero. At that time, the surface potential of the flare roller 12 is saturated, at which the surface potential of the flare roller 12 becomes substantially same as a bias voltage supplied to the supply roller 13, and thereby a toner supply potential is not maintained at a preferable level. The accumulated charges may dissipate gradually by setting power OFF to power sources used for supplying a bias voltage to the supply roller 13 and the flare roller 12. However, because the surface protection layer 34 has a relatively greater resistance for insulating electrodes, the accumulated charges may not dissipate or leak so easily. Accordingly, it may need a decharging device for the flare roller 12 to set the flare roller 12 at a preferred potential condition for image forming.

If the surface potential of flare roller 12 can be maintained at a given level by disposing a decharging device, a toner supply potential and developing potential may be maintained at a given level, and an image forming apparatus can produce images having less unevenness of image concentration.

(2) Frictional Electrification of Flare Roller and Supply Roller

Figure 15:
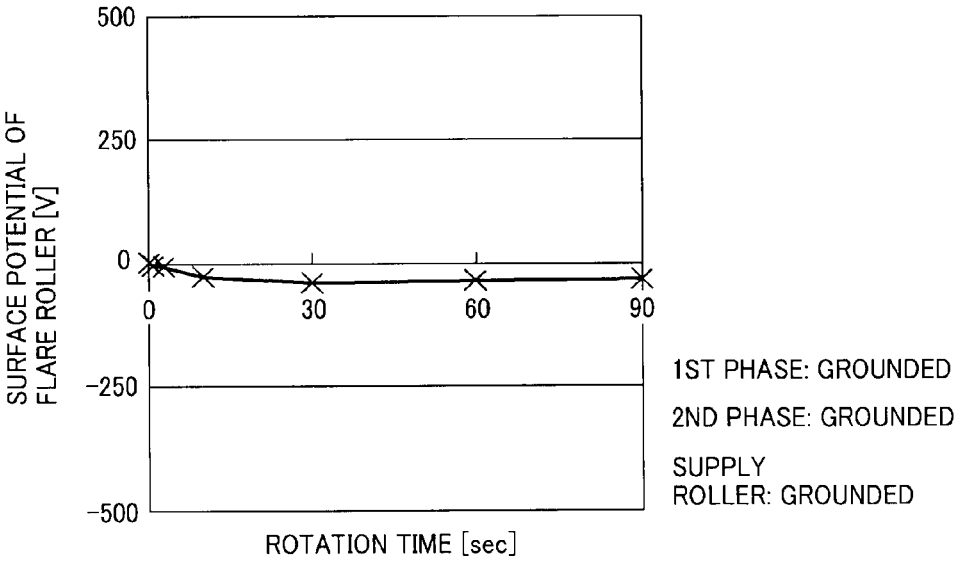
FIG. 15 is a graph of a surface potential of a flare roller with respect to a rotation time of flare roller, in which a toner supply roller and a flare roller are all grounded.

To estimate an effect of frictional electrification between the supply roller 13 and the flare roller 12 to the surface potential of the flare roller 12, the supply roller 13 and the flare roller 12 were grounded to eliminate an effect of a bias voltage supplied to the supply roller 13 and a bias voltage supplied to the flare roller 12. Under such configuration, the supply roller 13 and the flare roller 12 were rotated, and the surface potential of the flare roller 12 was measured over time to obtain measurement result shown in FIG. 15. The measurement result of FIG. 15 indicates that the flare roller 12 was charged to about −40 V by frictional electrification of the flare roller 12 and the supply roller 13. Such frictional charging and the time to reach the charging level is effected by several factors, such as material charging trend of the supply roller 13 and the surface protection layer the flare roller 12, and an impressing amount of the supply roller 13 to the flare roller 12.

(3) Inducement of Charges to Flare Roller to Cancel Negative Charged Toner

Figure 16:
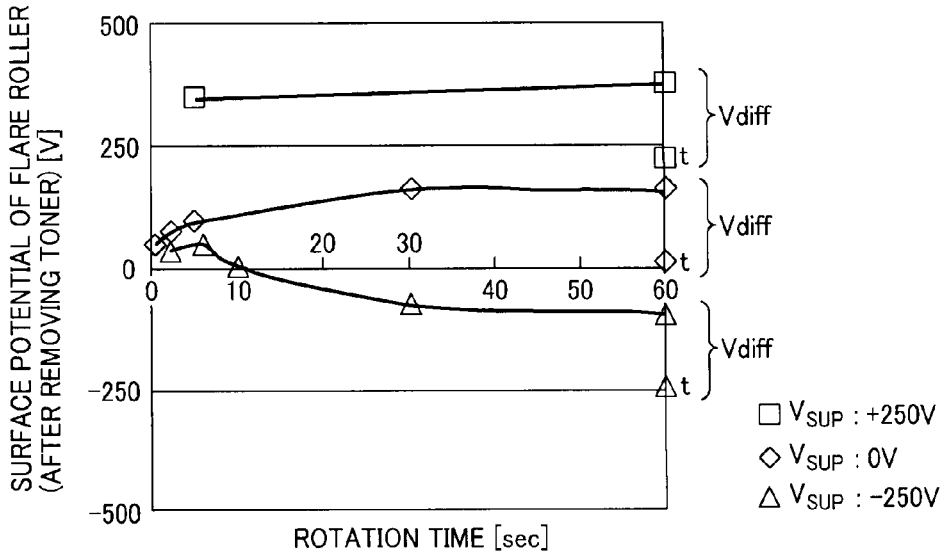
FIG. 16 is a graph of a surface potential of a flare roller with respect to a rotation time of a flare roller after removing toner by suctioning toner from the flare roller.

When negative-charged toner, supplied from the supply roller 13 to the flare roller 12, hops on or over the flare roller 12, an opposite charge (i.e., positive charge) is induced on the surface protection layer 34 of the flare roller 12. After removing the toner, the surface potential of the flare roller 12 was measured over time to obtain measurement result shown in FIG. 16. As shown in FIG. 16, different levels of bias voltages Vsup were supplied to the supply roller 13: Vsup of +250V, 0V, and −250V. The measurement results of FIG. 16 include two types of measured potential of the flare roller 12.

Separate points (see points having a suffix letter "t") at the time of 60 seconds indicate surface potential of the flare roller 12 measured with a condition that a bias voltage of the flare roller 12 is OFF (or grounded) and toner is still attracted on the flare roller 12. On one hand, potential points connected by a line indicate a surface potential of the flare roller 12 measured with a condition that toner is removed from the flare roller 12 by suctioning or air blowing toner (i.e., surface of flare roller 12 is exposed). At 60 seconds, two types of measured potential are compared, and it was found that a potential after removing toner is higher than a potential before removing toner. Such potential difference Vdiff may be 80 V to 150 V, for example. As such, the surface potential of the flare roller 12 has a positively charged condition, and the greater the toner charging amount, the greater the charge amount of the surface potential of the flare roller 12.

If only the aforementioned factor (1) of capacitor model occurs, fluctuation or variation of surface potential of the flare roller 12 can be prevented by not supplying a bias voltage to the supply roller 13 but rather by using a mechanically contactable device for toner supply and recovery. However, because the surface potential of the flare roller 12 may also be effected by the aforementioned factors (2) and (3), the surface potential of the flare roller 12 may fluctuate if the above described charged condition of the flare roller 12 is not suppressed. If the surface potential of the flare roller 12 fluctuates, a developing potential also fluctuates, and thereby a resultantly produced image may have lower image quality, such as uneven image concentration.

In view of such condition, a decharging process may be required for the surface of flare roller 12 to maintain the surface potential of the flare roller 12 at a given level, such as initial potential preferably set for image forming, so as to stably transport toner to the developing area facing the photoconductor 2 and to produce image having good quality.

In an exemplary embodiment, a given voltage (or bias voltage) is supplied to the toner sealing member 16 from a voltage application unit to maintain the surface potential of the flare roller 12 at a given level, such as an initial potential preferably set for image forming. Specifically, a bias voltage supplied to the toner sealing member 16 is set to a substantially same potential of the flare roller 12, by which charge injection to the flare roller 12 can be prevented, and the surface potential of the flare roller 12 can be stabilized at a given level. Accordingly, the toner sealing member 16 can also used as a decharging device for preventing the above described unpreferable fluctuation of surface potential of the flare roller 12.

As such, charge injection to the flare roller 12 can be prevented by setting a potential difference between an average voltage of the flare roller 12 and the toner sealing member 16 substantially zero. Accordingly, the surface potential of the flare roller 12 can be maintained at a given preferable level, such as an initial potential preferably set for image forming.

In contrast, if such potential difference between the flare roller 12 and the toner sealing member 16 is not set to zero, the surface potential of the flare roller 12 may be changed to another potential from a given preferable level due to such potential difference between the flare roller 12 and the toner sealing member 16.

Accordingly, a potential difference between the flare roller 12 and the photoconductor 2 having a latent image consisted of an image-written area and image-not-written area can be stabilized at a given level. Accordingly, a good level of image forming operation was conducted without causing unevenness on image concentration.

FIG. 1 shows an image forming apparatus having one latent image carrier (photoconductor 2) and four development units 10M, 10C, 10Y, and 10K employing the flare development configuration. Such a development unit employing the flare development configuration (see FIGS. 2, 8, 11, and 12) can be used in an image forming apparatus employing electrophotography for image forming, and can be used as a process cartridge for an image forming apparatus. A description is now given to a process cartridge having the development unit employing the flare development configuration according to an exemplary embodiment.

Figure 17:
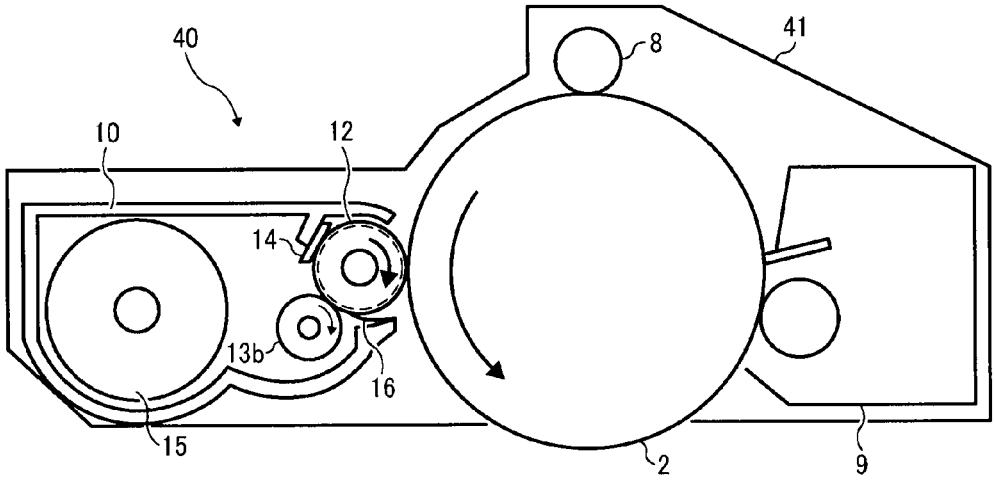
FIG. 17 illustrates a schematic configuration of another development unit according to another exemplary embodiment.

FIG. 17 illustrates a schematic cross-sectional view of a process cartridge used in an image forming apparatus employing electrophotography. The process cartridge 40 includes a photoconductor drum 2*a* as a latent image carrier, the charger 8, the development unit 10 employing the flare development configuration, the cleaning unit 9, and a cartridge casing 41. Although the process cartridge 40 integrally includes the photoconductor drum 2*a*, the charger 8, the development unit 10, and the cleaning unit 9, the process cartridge 40 may not to include all of such units. For example, the process cartridge 40 may integrally include the development unit 10 and at least one of the photoconductor drum 2*a*, the charger 8, and the cleaning unit 9.

An image forming apparatus can be configured with the process cartridge 40 used as a image forming unit, an optical writing unit, a transfer unit, a fixing unit, a sheet feeder, or the like. Further, because the process cartridge 40 is detachably mountable to the image forming apparatus, such process cartridge 40 can be replaced or recycled easily, by which maintenance of the image forming apparatus can be conducted easily, and resource saving can be enhanced.

Figure 18:
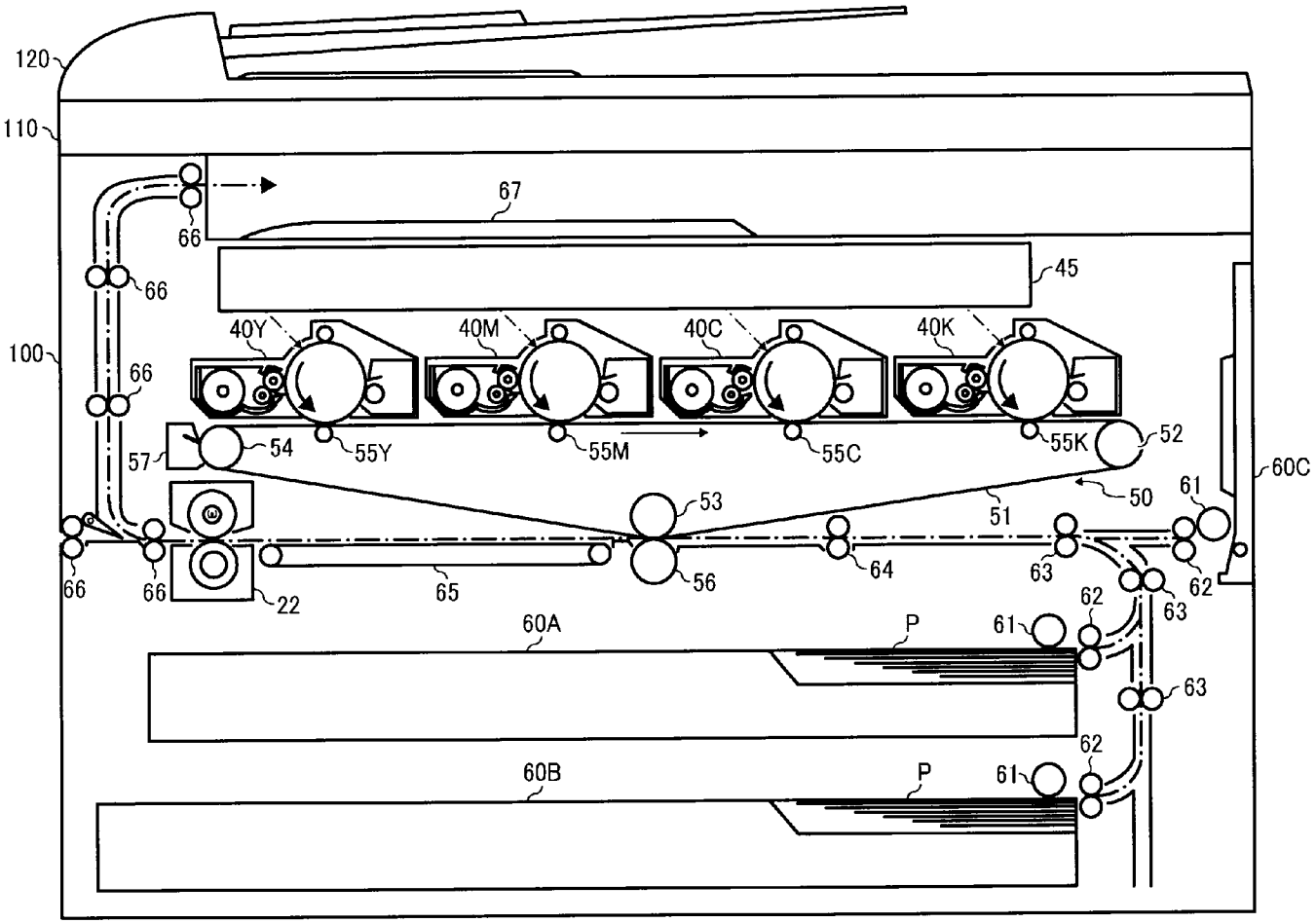
FIG. 18 illustrates a schematic configuration of an image forming apparatus using the development unit of FIG. 17.

FIG. 18 illustrates a schematic configuration of an image forming apparatus having a plurality of process cartridges 40, shown in FIG. 17, by which single color image, multi-color image, or full color image can be selectively formed. Such image forming apparatus including an image forming unit 100, a scanner 110, and an automatic document feeder (ADF) 120 can have multiple functions, such as a digital copier, a printer, a facsimile or the like. The image forming unit 100 forms images using image information of document scanned by the scanner 110, image information input from a personal computer via LAN (local area network), or image information transmitted from a remote place via communication line, for example.

The image forming unit 100 includes a transfer unit 50, which has an intermediate transfer belt 51 extended by a drive roller 52, a driven roller 54, and a counter roller 53, primary transfer rollers 55Y, 55M, 55C, and 55K, and a secondary transfer roller 56. The process cartridges 40Y, 40M, 40C, and 40K are disposed over the intermediate transfer belt 51 in tandem. In the process cartridge 40Y, the photoconductor drum 2*a* is charged by the charger 8 and exposed by a light beam coming from an optical writing unit 45 to form a latent image, and the development unit 10 develops a yellow toner image on the photoconductor drum 2*a* in the process cartridge 40Y. Similarly, a magenta toner image is formed on the photoconductor drum 2*a* in the process cartridge 40M, a cyan toner image is formed on the photoconductor drum 2*a* in the process cartridge 40C, and a black toner image is formed on the photoconductor drum 2*a* in the process cartridge 40K. Such toner images formed on the photoconductor drum 2*a* in the process cartridge 40Y, 40M, 40C, and 40K are sequentially superimposed and transferred to the intermediate transfer belt 51 by supplying a given transfer bias voltage to the primary transfer rollers 55Y, 55M, 55C, and 55K.

The image forming unit 100 includes sheet cassettes 60A and 60B under the transfer unit 50 to store a given volume of recording sheet P. The recording sheet P is transported to a registration roller 64 by feeding the recording sheet P one by one using a feed roller 61 and a separation roller 62 from any one of the sheet cassette 60A and 60B, and transporting the recording sheet P by a plurality of transport rollers 63. The recording sheet P may be fed from a manual feed tray 60C, disposed on a side face of the image forming unit 100.

Then, the registration roller 64 feeds the recording sheet P to a secondary transfer nip, set between the secondary transfer roller 56 and the counter roller 53 by synchronizing such feed timing with an image forming timing in the process cartridges 40Y, 40M, 40C, and 40K and a movement timing of the intermediate transfer belt 51 having the transferred toner images so as to transfer the toner images from the intermediate transfer belt 51 to the recording sheet P at the secondary transfer nip. The recording sheet P is then transported to the fixing unit 22 using a transport belt 65. The fixing unit 22 applies heat and pressure to fix the toner image on the recording sheet P. After the fixing process, the recording sheet P is ejected to an ejection tray 67 via a plurality of ejection rollers 66, or to a finisher. Further, after transferring the toner images, the photoconductor drum 2*a* is cleaned by the cleaning unit 9 to remove toner remaining on the photoconductor drum 2*a*. Further, after transferring the toner images, the intermediate transfer belt 51 is cleaned by a belt cleaning unit 54 to remove toner remaining on the intermediate transfer belt 51.

In such a configured image forming apparatus, the process cartridge 40Y, 40M, 40C, and 40K can be selectively driven to form single color image, multi-color image, or full color image. Further, because the process cartridges 40Y, 40M, 40C, and 40K are detachably mountable to the image forming apparatus, such process cartridge 40 can be replaced or recycled easily, by which maintenance of an image forming apparatus can be conducted easily, and resource saving can be enhanced.

In FIG. 18, the process cartridge 40Y, 40M, 40C, and 40K are arranged in tandem over the intermediate transfer belt 51 to configure an intermediate transfer method for an image forming apparatus. If a configuration that toner images are directly transferred to the recording sheet P from the photoconductor drum 2*a* is used, instead of using the intermediate transfer belt 51, an image forming apparatus employing a direct transfer method can be devised.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

The invention claimed is:

1. A development unit for a latent image carrier, comprising:

a toner carrying device facing the latent image carrier and configured to have a first electrode and a second electrode arrayed with a given interval, said first electrode and second electrode comprising respective circumferential electrodes extending along an edge circumference of the toner carrying device with each of the edge circumferential electrodes having at least one section extending longitudinally along an outer region of the toner carrying device, the first electrode and the second electrode each being supplied with a given voltage to set an electric field changing in a given time cycle between the first electrode and the second electrode, the electric field being used to hop toner particles on or over the toner carrying device to form a toner cloud for developing a latent image formed on the latent image carrier;

a regulating member configured to regulate an amount of toner on the toner carrying device; and a toner leak protection member made from a conductive material and configured to prevent leakage of toner particles from the development unit, the toner leak protection member being disposed at a downstream side of the regulating member with respect to a direction of surface movement of the toner carrying device, the toner leak protection member being supplied with a bias voltage, wherein the bias voltage comprises a voltage value being set to a same potential as an average potential of the given voltage supplied to any one of the first electrode and the second electrode.

2. The development unit according to claim 1, wherein:

the first electrode and the second electrode comprise a plurality of electrodes, and the first electrode and second electrode are arrayed alternately on the toner carrying device;

the first electrode is supplied with a first voltage as the given voltage, and the second electrode is supplied with a second voltage as the given voltage;

the first voltage supplied to the first electrode has a first phase pattern changing in a given time cycle;

the second voltage supplied to the second electrode has a second phase pattern changing in a given time cycle, the second phase pattern is an opposite phase of the first phase pattern; and the bias voltage for the toner leak protection member comprises a direct current voltage.

3. The development unit according to claim 1, wherein:

the first electrode and the second electrode comprise a plurality of electrodes, and the first electrode and second electrode are arrayed alternately on the toner carrying device;

the first electrode is supplied with a first voltage as the given voltage, and the second electrode is supplied with a second voltage as the given voltage;

the first voltage supplied to the first electrode has a first phase pattern changing in a given time cycle;

the second voltage supplied to the second electrode is a direct current voltage; and the bias voltage for the toner leak protection member comprises a direct current voltage.

4. The development unit according to claim 1 wherein:

the first electrode and the second electrode comprise a plurality of electrodes, and the first electrode and second electrode are arrayed alternately on the toner carrying device;

the first electrode is supplied with a first voltage as the given voltage, and the second electrode is supplied with a second voltage as the given voltage;

the first voltage supplied to the first electrode has a first phase pattern changing in a given time cycle;

the second voltage supplied to the second electrode has a second phase pattern changing in a given time cycle, the second phase pattern is an opposite phase of the first phase pattern; and the bias voltage for the toner leak protection member comprises a third voltage changing in a given time cycle.

5. The development unit according to claim 4, wherein the third voltage supplied to the toner leak protection member is set to any one of the first voltage and the second voltage.

6. The development unit according to claim 1, wherein:

the first electrode and the second electrode comprise a plurality of electrodes, and the first electrode and second electrode are arrayed alternately on the toner carrying device;

the first electrode is supplied with a first voltage, and the second electrode is supplied with a second voltage;

the first voltage supplied to the first electrode has a first phase pattern changing in a given time cycle;

the second voltage supplied to the second electrode is a direct current voltage; and the bias voltage for the toner leak protection member comprises the first voltage.

7. The development unit according to claim 1, wherein the toner leak protection member comprises an elastic and conductive material and is formed into a thin plate.

8. The development unit according to claim 1, wherein the toner leak protection member comprises an elastic and conductive material and is formed into a cylindrical shape.

9. The development unit according to claim 1, wherein a separation between the first and second electrode is set to a distance R within a range from one average particle diameter of the toner particles to twenty times the average particle diameter of the toner particles.

10. An image forming apparatus, comprising:

a latent image carrier configured to carry a latent image; and a development unit configured to develop the latent image carrier, the development unit comprising:

a toner carrying device facing the latent image carrier and configured to have a first electrode and a second electrode arrayed with a given interval, said first electrode and second electrode comprising respective circumferential electrodes extending along an edge circumference of the toner carrying device with each of the edge circumferential electrodes having at least one section extending longitudinally along an outer region of the toner carrying device, the first electrode and the second electrode being supplied with a given voltage to set an electric field changing in a given time cycle between the first electrode and the second electrode, the electric field being used to hop toner particles on or over the toner carrying device to form a toner cloud for developing a latent image formed on the latent image carrier;

a regulating member configured to regulate an amount of toner on the toner carrying device; and a toner leak protection member made from a conductive material and configured to prevent leakage of toner particles from the development unit, the toner leak protection member being disposed at a downstream side of the regulating member with respect to a direction of surface movement of the toner carrying device, the toner leak protection member being supplied with a bias voltage, wherein the bias voltage comprises a voltage value being set to a same potential as an average potential of the given voltage supplied to any one of the first electrode and the second electrode.

11. The image forming apparatus according to claim 10, wherein the development unit included in the image forming apparatus comprises a plurality of development units to sequentially develop a latent image on the latent image carrier with a plurality of toner color images to form a superimposed color image on the latent image carrier.

12. The image forming apparatus according to claim 10, wherein a separation between the first and second electrode is set to a distance R within a range from one average particle diameter of the toner particles to twenty times the average particle diameter of the toner particles.

13. A process cartridge detachably mountable in an image forming apparatus employing electrophotography and having a latent image carrier for carrying a latent image, a charger, and a cleaning unit, comprising:

a development unit, being integrated with at least any one of the latent image carrier, the charger, and the cleaning unit, configured to develop the latent image carrier, the development unit, comprising:

a toner carrying device facing the latent image carrier and configured to have a first electrode and a second electrode arrayed with a given interval, said first electrode and second electrode comprising respective circumferential electrodes extending along an edge circumference of the toner carrying device with each of the edge circumferential electrodes having at least one section extending longitudinally along an outer region of the toner carrying device, the first electrode and the second electrode being supplied with a given voltage to set an electric field changing in a given time cycle between the first electrode and the second electrode, the electric field being used to hop toner particles on or over the toner carrying device to form a toner cloud for developing a latent image formed on the latent image carrier;

a regulating member configured to regulate an amount of toner on the toner carrying device; and a toner leak protection member made from a conductive material and configured to prevent leakage of toner particles from the development unit, the toner leak protection member being disposed at a downstream side of the regulating member with respect to a direction of surface movement of the toner carrying device, the toner leak protection member being supplied with a bias voltage, wherein the bias voltage comprises a voltage value being set to a same potential as an average potential of the given voltage supplied to any one of the first electrode and the second electrode.

14. The process cartridge according to claim 13, wherein the image forming apparatus includes the process cartridge with a plurality of process cartridges.

15. The process cartridge according to claim 13, wherein a separation between the first and second electrode is set to a distance R within a range from one average particle diameter of the toner particles to twenty times the average particle diameter of the toner particles.

16. A development unit, comprising:

a toner carrier, disposed at an opposing position of a latent image carrier, having a plurality of electrodes composed of a first electrode group and a second electrode group arranged alternately with a given interval along a circumferential direction of a surface of a roller;

a supply unit, contactable on a surface of the toner carrier, to supply toner to the toner carrier while rotating in a counter direction of the toner carrier;

a regulating member to regulate the thickness of toner carried on a surface of the toner carrier;

a toner-leak prevention member, made of a conductive material, disposed at a position between a downstream side of a development area and an upstream side of the regulating member along a direction of surface moving of the toner carrier;

a voltage supply unit to apply a first rectangular bias to the first electrode group, and a second rectangular bias to the second electrode group, the second rectangular bias having a phase opposite to a phase of the first rectangular bias applied to the first electrode group so that an electric field between adjacently disposed electrodes of the first electrode group and electrodes of the second electrode group is variable over time;

wherein the electric field is used to fly toner carried on the surface of the toner carrier to form a cloud, wherein the development unit develops a latent image formed on the latent image carrier by adhering toner on the latent image, wherein the toner-leak prevention member is applied with a direct current bias having a same level as an average value of the first rectangular bias applied to the first electrode group or an average value of the second rectangular bias applied to the second electrode group.

* * * * *